US012736061B2

(12) United States Patent
Obermeyer

(10) Patent No.: US 12,736,061 B2
(45) Date of Patent: Sep. 15, 2026

(54) MULTIPLE BLADE ROWS FOR IMPELLER AND DIFFUSER STAGES

(71) Applicant: Henry K. Obermeyer, Wellington, CO (US)

(72) Inventor: Henry K. Obermeyer, Wellington, CO (US)

(73) Assignee: Henry K. Obermeyer, Wellington, CO (US)

( * ) Notice: Subject to any disclaimer, the term of this patent is extended or adjusted under 35 U.S.C. 154(b) by 0 days.

(21) Appl. No.: 18/780,231

(22) Filed: Jul. 22, 2024

(65) Prior Publication Data

US 2025/0027507 A1 Jan. 23, 2025

Related U.S. Application Data

(60) Provisional application No. 63/528,310, filed on Jul. 21, 2023.

(51) Int. Cl.
*F04D 29/22* (2006.01)
*F04D 1/06* (2006.01)
(Continued)

(52) U.S. Cl.
CPC ..... *F04D 29/2205* (2013.01); *F04D 1/06* (2013.01); *F04D 13/10* (2013.01); *F04D 29/445* (2013.01)

(58) Field of Classification Search
CPC ..... F04D 1/06; F04D 13/10; F04D 29/2205; F04D 29/448
See application file for complete search history.

(56) References Cited

U.S. PATENT DOCUMENTS 1,199,360 A 9/1916 Foettinger
1,529,634 A 3/1925 Forrest
(Continued)

FOREIGN PATENT DOCUMENTS

CA 1289869 C 10/1991
CN 1057704 A 1/1992
(Continued)

OTHER PUBLICATIONS

International Search Report and Written Opinion of the International Searching Authority issued in International Application No. PCT/US2024/039054, mailed Nov. 14, 2024, 16 pages.
(Continued)

*Primary Examiner* — Brian O Peters

(57) ABSTRACT

A machine that includes a centrifugal impeller and a diffuser. The impeller has two rows of impeller blades. A first row accelerates the flow away from the axis of rotation, and discharges the flow in an outward radial direction to a second row of impeller blades. The second row first accelerates the flow toward the axis of rotation in an inward radial direction, and then accelerates the flow in the first axial direction. The diffuser has two rows of diffuser blades. A first row of diffuser blades first accelerates the flow in the first axial direction, and then accelerates the flow toward the axis of rotation. The second row of diffuser blades first accelerates the flow away from the axis of rotation, then accelerates the flow in the first axial direction, and then discharges the flow from the diffuser in the first axial direction.

11 Claims, 27 Drawing Sheets

(51) Int. Cl.
*F04D 13/10* (2006.01)
*F04D 29/44* (2006.01)

(56) References Cited

U.S. PATENT DOCUMENTS 1,757,926 A 5/1930 Moody
2,022,975 A 12/1935 Arnold
2,246,472 A 6/1941 Sharp
2,357,338 A 9/1944 Lysholm
2,608,663 A 8/1952 Wales
2,630,682 A 3/1953 Wemp et al.
2,710,504 A 6/1955 Dodge
2,753,808 A * 7/1956 Kluge ..... F01D 5/145 416/91
2,952,976 A 9/1960 Alexandrescu
3,071,928 A 1/1963 Dundore et al.
3,093,084 A 6/1963 Derderian
3,105,396 A 10/1963 Dundore et al.
3,125,857 A 3/1964 Schneider
3,163,118 A 12/1964 Baumann
3,167,918 A 2/1965 Alexandrescu
3,276,461 A 10/1966 Gleb
3,320,747 A 5/1967 Denes
3,330,111 A 7/1967 Denes
3,360,935 A 1/1968 Schneider
3,398,932 A 8/1968 Koeller et al.
3,398,935 A 8/1968 Livesey et al.
3,614,268 A 10/1971 Merenda
3,721,090 A 3/1973 Ahlen
3,756,028 A 9/1973 Bopp et al.
3,785,154 A 1/1974 Malik
3,794,456 A 2/1974 Jelusic
3,810,717 A 5/1974 Rakcevic
3,867,059 A 2/1975 Fauconnet
3,888,082 A 6/1975 Haide
3,965,680 A 6/1976 Cottrell et al.
4,004,605 A 1/1977 Rakcevic
4,008,010 A 2/1977 Fauconnet
4,129,000 A 12/1978 Umeda et al.
4,167,854 A 9/1979 Diemer et al.
4,177,885 A 12/1979 Ross
4,191,015 A 3/1980 Komatsu et al.
4,217,077 A 8/1980 Brcar
4,272,686 A 6/1981 Suzuki
4,275,989 A 6/1981 Atencio
4,416,328 A 11/1983 Baski
4,431,446 A 2/1984 Yamamoto et al.
4,441,029 A 4/1984 Kao
4,472,104 A 9/1984 Kuwabara
4,496,845 A 1/1985 Ensign et al.
4,502,837 A * 3/1985 Blair ..... F04D 29/284 415/198.1
4,538,957 A 9/1985 Yamagata et al.
4,615,659 A * 10/1986 Sidransky ..... F04D 29/681 416/196 R
4,624,105 A 11/1986 Nishimura et al.
4,726,185 A 2/1988 Shigemasa et al.
4,804,855 A 2/1989 Obermeyer
4,908,924 A 3/1990 Tsuruta et al.
5,005,356 A 4/1991 Saunders
5,058,027 A 10/1991 Becraft
5,213,473 A * 5/1993 Fiala ..... F01D 5/048 416/185
5,226,807 A 7/1993 By et al.
5,261,787 A 11/1993 Morgunov
5,516,263 A 5/1996 Nishida et al.
5,561,358 A 10/1996 Kuwabara et al.
5,860,500 A 1/1999 Olsen et al.
6,250,887 B1 6/2001 Kuwabara et al.
6,289,674 B1 9/2001 Halene et al.
6,311,770 B1 11/2001 Mullis
6,405,994 B1 6/2002 Chen
6,820,333 B2 11/2004 Shimmei et al.
7,003,955 B2 2/2006 Davis
7,092,795 B2 8/2006 Kuwabara
7,152,399 B2 12/2006 Schweitzer et al.
7,621,122 B2 11/2009 Marathe et al.
7,634,910 B2 12/2009 Marathe et al.
7,837,450 B2 11/2010 Moreland
8,072,089 B2 12/2011 Krouse et al.
8,193,652 B2 6/2012 Paoli
8,215,104 B2 7/2012 Riley
8,485,250 B1 7/2013 Rose
8,536,723 B2 9/2013 Roos
8,823,195 B2 9/2014 Legacy
9,059,605 B2 6/2015 Murray et al.
9,109,571 B2 8/2015 Sepp et al.
9,494,164 B2 11/2016 Baski
9,683,540 B2 6/2017 Winkler et al.
10,890,189 B2 * 1/2021 Eslinger ..... F04D 29/445
11,053,952 B2 * 7/2021 Nakaniwa ..... F04D 17/122
11,300,093 B2 4/2022 Obermeyer et al.
2002/0040622 A1 4/2002 Tsunekawa et al.
2003/0147760 A1 8/2003 Chiang
2004/0047728 A1 3/2004 Kao
2004/0118113 A1 6/2004 Fukunaga et al.
2005/0145111 A1 * 7/2005 Keefer ..... B01D 53/0431 96/124
2005/0241901 A1 11/2005 Joo et al.
2012/0201672 A1 8/2012 Sepp et al.
2013/0045086 A1 2/2013 Stummer
2013/0302187 A1 11/2013 Stummer
2014/0161586 A1 6/2014 Stummer
2014/0241873 A1 8/2014 Degala
2014/0246859 A1 9/2014 Obermeyer
2015/0044027 A1 2/2015 Dam et al.
2015/0098793 A1 4/2015 Baski
2015/0098794 A1 4/2015 Baski
2015/0159472 A1 6/2015 Wolf et al.
2016/0090864 A1 3/2016 Finley
2016/0102668 A1 4/2016 Tivarovsky
2016/0341173 A1 11/2016 Coulon
2016/0377195 A1 12/2016 Milroy
2017/0023088 A1 1/2017 Kadowaki
2017/0241399 A1 8/2017 Kanyua
2018/0040226 A1 2/2018 Zhang et al.
2019/0186458 A1 6/2019 Obermeyer et al.
2022/0205452 A1 6/2022 Mitsuda et al.

FOREIGN PATENT DOCUMENTS

CN 1127335 A 7/1996
CN 102384005 A 3/2012
CN 102434362 A 5/2012
CN 102953913 A 3/2013
CN 103370531 A 10/2013
CN 103620210 A 3/2014
CN 103759069 A 4/2014
CN 103958886 A 7/2014
CN 104093970 A 10/2014
CN 106662067 A 5/2017
DE 102014223942 A1 6/2016
GB 674499 A 6/1952
GB 953351 A 3/1964
GB 1220712 A 1/1971
IL 98439 A 6/1994
JP S53112345 A 9/1978
JP S5781165 A 5/1982
JP S5963371 A 4/1984
JP 2007024021 A 2/2007
JP 2012251538 A 12/2012
JP 2013194558 * 9/2013
JP 2013194558 B2 9/2013
JP 2014528554 A 10/2014
KR 20040064666 A 7/2004
RU 54379 U1 6/2006
RU 2754049 C1 * 8/2021 ..... F04D 13/10
WO 0068598 A1 11/2000
WO 2012024356 A1 2/2012

(56) References Cited

FOREIGN PATENT DOCUMENTS

| | | |
|---|---|---|
| WO | 2013132098 A2 | 9/2013 |
| WO | 2017093016 A1 | 6/2017 |

OTHER PUBLICATIONS

Challenges and Opportunities for New Pumped Storage Development: A White Paper Developed by NHA's Pumped Storage Development Council, National Hydropower Association, 2012, 33 pages.
"Five in focus—new pumped storage schemed," International Water Power & Dam Construction, Dec. 22, 2010.
"Medium Voltage Switchgear & Products of the MV Network," Medium Voltage Distribution Catalog, Schneider Electrical Industries SAS, 2015, 172 pages.
"Pitless Adapters: What You Need to Know," YouTube, https://www.youtube.com/watch?v-gUO8FK_hfMk, 2018.
Beyer, Goldisthal Pumped-Storage Plant: More than Power Production, Hydro Review, Mar. 1, 2007, 14 pages.
Brochure, "Drives for every demand: The SINAMICS family of medium voltage drives," Siemens AG, 2016, 2 pages.
Brochure, "MV 7000: Reliable, high performance medium voltage drive," GE Power Conversion, General Electric Company, 2013, 10 pages.
Brochure, "Product Offering: Adjustable Speed Drives," Toshiba International Corporation, 2014, 6 pages.
Brochure, "Pumped storage machines: Reversible pump turbines, Ternary sets and Motor-generators," Voith Hydro Holding Gmbh & Co KG, Retrieved from: https://voith.com/corp-en/11_06_Broschuere-Pumped-storage_einzeln.pdf.
Brochure, Allen-Bradley, Regenerative AC Drives: Understanding Regeneration, Rockwell International Corporation, Publication 1336R-WP002A-EN-P, Feb. 2001, 14 pages.
Brochure, GE Power: Generators, GEA32229, General Electric Company, 2015, 2 pages.
Brochure, Module 5 DC to AC Converters, Version 2 EE IIT, Kharagpur, Lesson 33: Introduction to Voltage Source Inverters, 14 pages.
Brochure, MV1000 Specification Guide, Yaskawa, SG.MV1000.01, (Rev 1) Sep. 23, 2013, 20 pages.
Budris, "Using Pumps as Power Recovery Turbines," WaterWorld, Aug. 1, 2009, 9 pages.
Catalog entitled "Goulds Pumps—Vertical Turbine Pumps," (ITT Corporation) 2012, pp. 11 & 12, XP055658671, Retrieved from the Internet: https://www.gouldspumps.com/ittgp/medialibrary/goulds/website/Literature/Brochures/Product%20Bulletins/Alphabetical/Goulds_Vertical_Reader.pdf?ext=.pdf. 20 pgs.
Catalog, "Distribution Solutions: VM1—Medium voltage vacuum circuit breakers with magnetic drive—12 . . . 24 kV—630 . . . 4000 A—16 . . . 50 kA," ABB Library, Document ID 1VCP000157 2014.03, Jun. 20, 2018.
Datasheet, Infineon FZ600R65KE3, Edition Jan. 15, 2018, Infineon Technologies AG, Copyright 2018, 9 pages.
Eagle Mountain Pumped Storage Project No. 13123 Final License Application, vol. 1 of 6, Exhibits A and B, Submitted to: Federal Energy Regulatory Commission, Submitted by: Eagle Crest Energy Company, Jun. 22, 2009, GEI Project No. 080473, 50 pages.
Erickson, "Future Directions in Wind Power Conversion Electronics," Stanford Global Climate and Energy Project, Wind power workshop, invited presentation, Apr. 26, 2004.
Extended European Search Report issued in EP Patent Application No. 18823779.6, mailed Dec. 2, 2020, 10 pages.
First Office Action issued in CN Patent Application No. 201880003305.4, mailed Jun. 24, 2021, 15 pages.
Getzlaff, Fundamentals of Magnetism, ISBN 978-3-540-31150-8, Springer-Verlag Berlin Heidelberg, Copyright 2008.
HydraForce RVCV56-20—Relief Direct Acting, Anti-cavitation, 2013, 4 pages.
Infineon, AN2011-05 Industrial IGBT Modules Explanation of Technical Information, V1.2 Nov. 2015.
Ingram, "Worldwide Pumped Storage Activity," Hydro Review, Sep. 1, 2010, 18 pages.
International Search Report and Written Opinion of the International Searching Authority issued in International Application No. PCT/US2017/048769, mailed Nov. 2, 2017, 8 pages.
International Search Report and Written Opinion of the International Searching Authority issued in International Application No. PCT/US2018/030310, mailed Jul. 26, 2018, 7 pages.
Levett et al., "Cascade topology-based medium voltage motor drives: Operation theory and silicon options," EDN network, Jul. 19, 2017, 10 pages.
Maharjan et al., "Design of Reversible Pump Turbine for its prospective application in Nepal," International Journal of Scientific and Research Publications, vol. 4, Issue 7, Jul. 2014, 8 pages.
McLyman, W T, Transformer and Inductor Design Handbook, Third Edition, Marcel Dekker, Inc., © 2004, 532 pages.
Moran, Multi-Megawatt Motor Drive Technology, Mar. 30, 2009, 18 pages.
Office Action issued in IN Patent Application No. 201917016740, mailed Oct. 1, 2021, 7 pages.
Office Action issued in Japanese Patent Application No. 2019-510408, mailed Dec. 21, 2021, 22 pages.
Original Faesch & Piccard Design of Wheel-Pit for Power-House No. One [Source and Date Unknown].
Second Office Action issued in CN Patent Application No. 201880003305.4, mailed Apr. 14, 2022, 13 pages.
Shubhra (Mieee, Lmiete), "MATLAB/Simulink Based Model for 25 kV AC Electric Traction Drive," International Journal of Engineering Research & Technology (IJERT), ISSN: 2278-0181, vol. 3, Issue 5, May 2014.
Stelzer et al., "Estimating Reversible Pump-Turbine Characteristics," A Water Resources Technical Publication, Engineering Monograph No. 39, United States Department of the Interior, Bureau of Reclamation, Dec. 1977, 48 pages.
U.S. Appl. No. 62/527,010, filed Jun. 29, 2017.
U.S. Appl. No. 62/664,849, filed Apr. 20, 2018.
Van Der Merwe, "Protection at a pumped storage station uses static frequency starting," Energize, May 2013, pp. 21-26.
Wang et al, "A Transformerless Medium Voltage Multiphase Motor Drive System," Energies, vol. 9, Issue 5, 10.3390/en9050323, Apr. 27, 2016.
Wang et al., "Analysis of a Static Start-up Control Strategy for Pumped Storage Power Plant Unit," Physics Procedia, vol. 24, 2012, pp. 155-162.
Witt et al., Evaluation of the Feasibility and Viability of Modular Pumped Storage Hydro (m-PSH) in the United States, ORNL/TM-2015/559, Oak Ridge National Laboratory, Sep. 2015, 83 pages.
Yang et al., "Permanent Magnetic Generator Design and Control for Large Wind Turbines," IEEE Power Electronics and Machines in Wind Applications (PEMWA), 2012.

* cited by examiner

MULTIPLE BLADE ROWS FOR IMPELLER AND DIFFUSER STAGES

CROSS-REFERENCES TO RELATED APPLICATIONS

This patent application claims the benefit of provisional Application No. 63/528,310 filed Jul. 21, 2023. That application is incorporated into the present disclosure by this reference.

TECHNICAL FIELD

The subject matter is related to apparatus and methods for impeller and diffuser stages, particularly for use in multistage, hydromotive machines.

BACKGROUND

Multistage pumps and compressors generally incorporate centrifugal impellers, each with an axial inlet and a radial outlet. Returning the fluid or gas to the impeller of the next stage results in a tortuous fluid path that follows an "obstacle course" of sorts between relatively small diameter impeller eye inlets and large diameter impeller discharge diameters and then back again through diffusers between stages. Furthermore, the radial discharge requires that the diffuser accept radial flow. This results in an unnecessarily large diffuser diameter and an unnecessarily large overall pump or compressor diameter. In the case of submersible well pumps, diameter allocated to the diffuser is not available for the impeller so the number of stages must be increased to achieve the design head, while the flow capacity remains limited by impeller diameter.

Constraining the fluid to a conventional axial impeller inlet/radial impeller outlet flow pattern in the meridional plane results in the need to make a sharp reversal in the meridional plane to return the flow to the next stage via a diffuser. The need for an abrupt reversal in direction in the meridional plane can be relieved by following a more gently curved meridional trajectory. A gentle sinusoidal meridional path or a path comprised of circular segments and straight lines, for example, results nonetheless in the direction of acceleration in the meridional plane having to reverse partway through the pump impeller and reverse again partway through the diffuser. This confounds the designers' attempts to maintain a smooth blade surface because the acceleration vector that the impeller blades and the diffuser vanes must impart to the flow change abruptly halfway through the impeller and the change abruptly again partway through the diffuser.

Referring to FIG. 1, a prior art multistage centrifugal pump is illustrated. Note how large the pump casing is with respect to the impeller diameter. Note also the tortuous fluid path from the exit of one impeller to the entrance of the next impeller. Such pumps are generally heavy, bulky, and inefficient in comparison to the disclosed technology. Efficiencies for such multistage pumps are typically 60% to 80%.

Referring to FIG. 2, a prior art multistage centrifugal compressor is shown. Note again the very large diameter of the required housing (labeled as "D" in FIG. 2) in relation to the impeller diameter (labeled as "d" in FIG. 2). Note as well the tortuous flow path from the exit of one impeller to the entrance of the next.

Configurations of the disclosed technology address shortcomings in the prior art.

DETAILED DESCRIPTION

Figure 1:
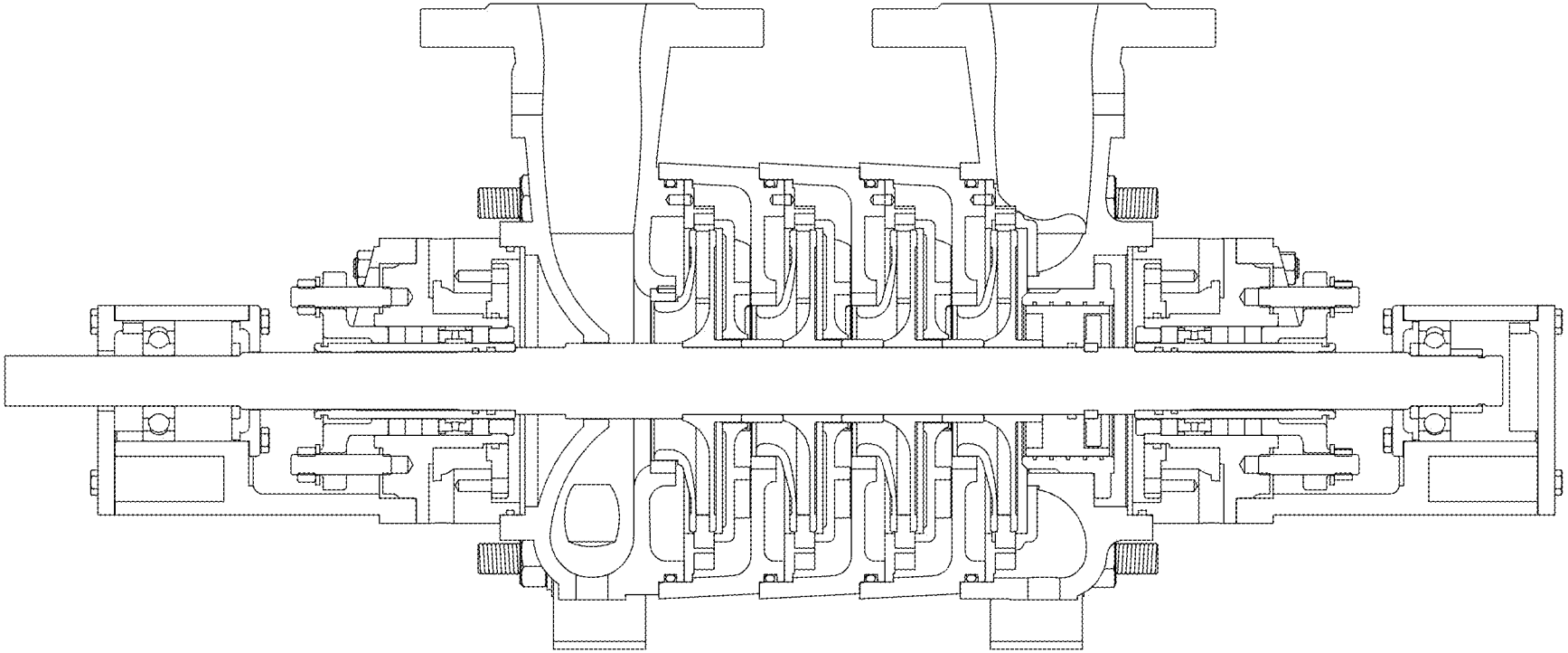
FIG. 1 Prior Art
FIG. 1 is a prior-art multistage pump that uses conventional (not tandem) blades.
Figure 2:
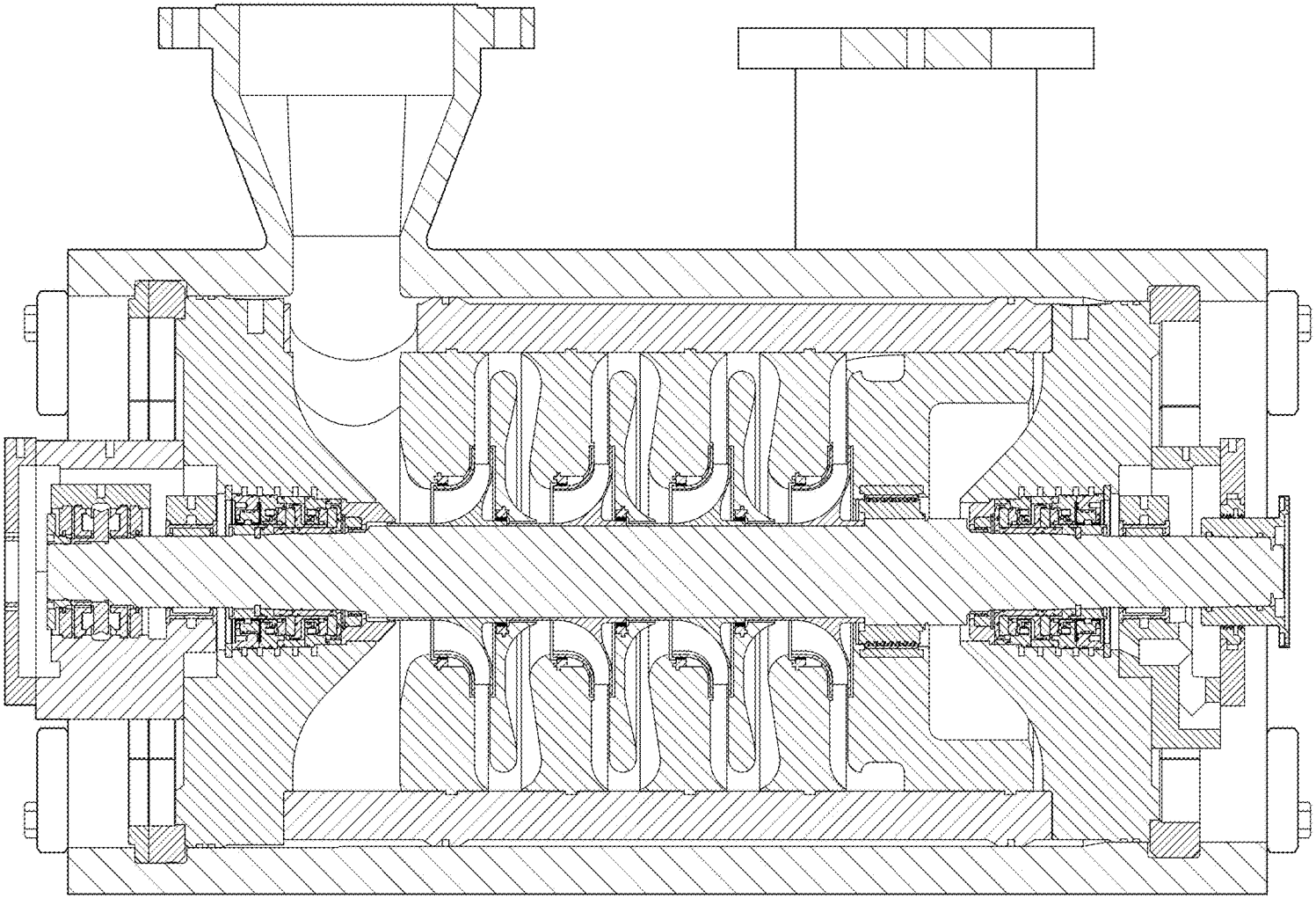
FIG. 2 Prior Art
FIG. 2 illustrates a prior-art multistage centrifugal compressor.

As described herein, aspects are directed to a multistage, multi-blade-row, centrifugal compressor or pump with improvements over the prior art.

The dilemma explained in the Background section that confounds designers can be solved by using separate blade rows within any impeller stage and within any diffuser stage. Each of these blade rows may be configured to provide continuous meridional plane acceleration from blade leading edges to blade trailing edges. With this approach, changes in the meridional direction of acceleration within any single blade row may be eliminated. This eliminates the need to twist the blades between zones of differing meridional plane acceleration and thus eliminates the flow separations, secondary flows, and efficiency penalties that twisted blades tend to produce. The number of blade rows depends on the number of distinct zones of meridional acceleration. Accordingly, a solution to avoiding an otherwise abrupt change in blade orientation mid chord (i.e. midway between the leading edge and the trailing edge of the blade), where the acceleration vector within the meridional plane should change, is to simply make a clean break between differently oriented blade rows. Each blade row is oriented in accordance with its required influence on the fluid.

The intent of this technology may be met with two zones (i.e. two blade rows) only, but at the expense of greater stage axial length and at the expense of greater machine weight, size, and cost (both relative to versions having three blade rows). In this configuration tandem blades may be used. The first impeller blade row may accept axial inlet flow and then accelerate the flow away from the axis of rotation and discharge it radially to the second impeller blade row. The second impeller blade row accepts the radial inlet flow and accelerates it in a circular fashion within the meridional plane, initially axially and then gradually toward the axis of rotation. This second impeller blade row of the tandem blade row pair discharges axially into a subsequent diffuser blade row that begins its acceleration of the flow in the radially inward direction and then gradually changes the direction of acceleration to axial, having imparted a radially inward direction of flow to the fluid. The next diffuser blade row initially accelerates the flow axially but then smoothly transitions to a radial outward acceleration of the flow. This second row of blades in the tandem diffuser ends and discharges the flow in an axial direction into either the next impeller stage or into an outlet manifold.

An axially more compact arrangement may be configured using three blade rows in each stage which may be used to accelerate the flow from an axial inlet to align with a generally radial blade row. The generally radial blade row is then followed by a final blade row that accepts generally radial inflow but discharges axially.

The analogous opportunity to coordinate acceleration and deceleration vectors occurs in each diffuser stage where incoming axial flow (typically at large diameter) from the preceding impeller must first be accelerated to flow radially toward the shaft centerline, and then partway there, accelerated again to flow axially and in alignment with the next impeller stage. In order to achieve the required changes in acceleration within the same impeller stage two distinct tandem blade rows may be used in order to avoid the use of abruptly twisted continuous blades that would cause flow separation, secondary flow, and cavitation. The first of the tandem blade rows is aligned to convert tangential kinetic energy into pressure, but also to direct the flow toward the shaft centerline. The second half of the tandem stages is aligned on one axis to continue to convert tangential kinetic energy to pressure, while it is aligned on a nearly orthogonal axis and within the meridional plane to accelerate the flow away from the shaft centerline. This can also be thought of as decelerating its approach toward the shaft centerline. It is this switch in acceleration vector and surface orientation mid-chord that is required to achieve the required flow, but which is not possible to accomplish without interruption of the blade surface and division of the hypothetical single blade into two more effective tandem blades.

The favorable performance of the axial-in-axial-out impeller of U.S. Pat. No. 11,300,093 supports the notion that uninterrupted continuous acceleration and uninterrupted continuous blade surface orientation prevents efficiency sapping secondary flows and attendant flow separation. In accordance with the disclosed technology these benefits can be extended to multistage centrifugal pumps and multistage centrifugal compressors. It should be noted that secondary flows and separated flows may lead to turbulence which may in turn lead to cavitation. The disclosed technology thus not only improves pump efficiency, but also generally results in reduced levels of cavitation.

Also, while the discussion that follows is in reference to a pump for simplicity and readability, it is recognized that the hydromotive machine need not be a pump in all configurations. Instead, the hydromotive machine might also be, as examples, a turbine, a blower, a compressor, a turbocharger, a supercharger, a gas turbine, a reversible pump-turbine or other hydromotive or aeromotive machine. It should be further noted that the disclosed technology is also applicable to single-stage hydromotive machines in addition to multistage hydromotive machines that are the focus of the discussion that follows.

Figure 3:
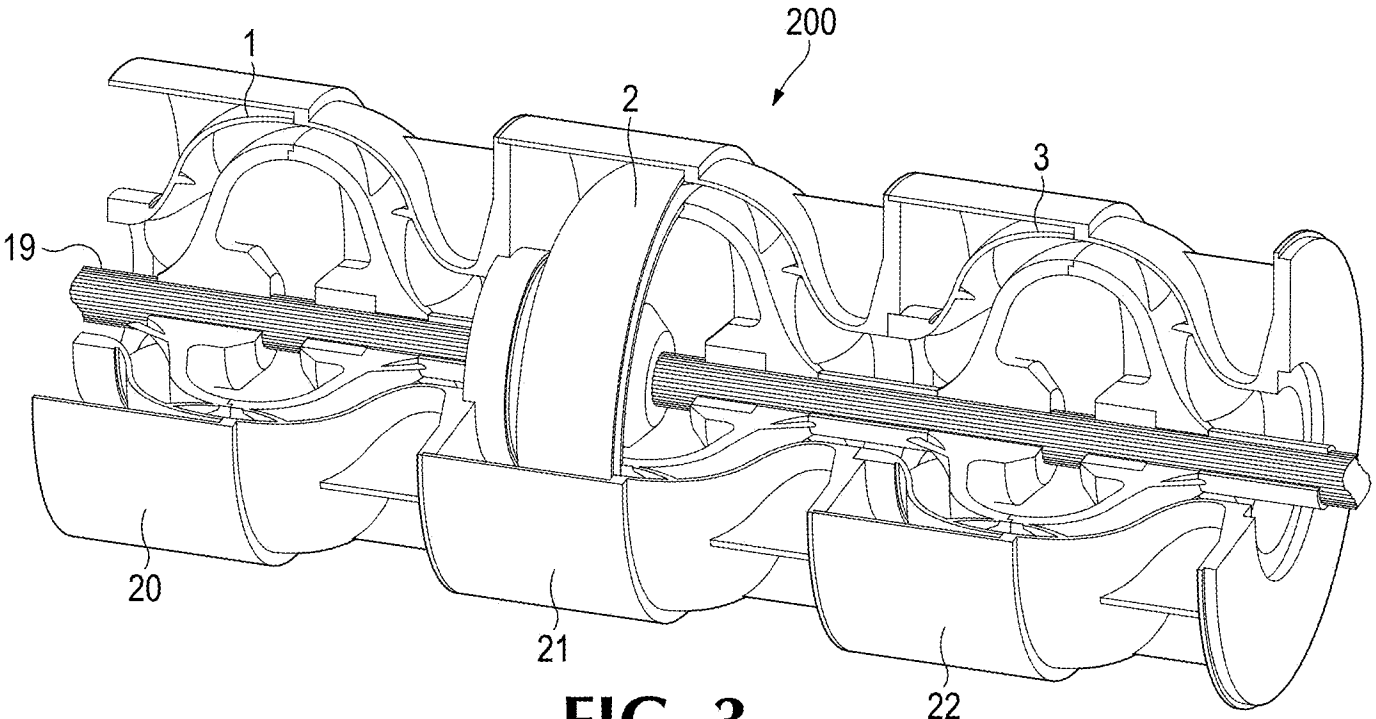
FIG. 3 is a cutaway view of a multistage, tandem-blade-row pump, according to an example configuration.
Figure 4:
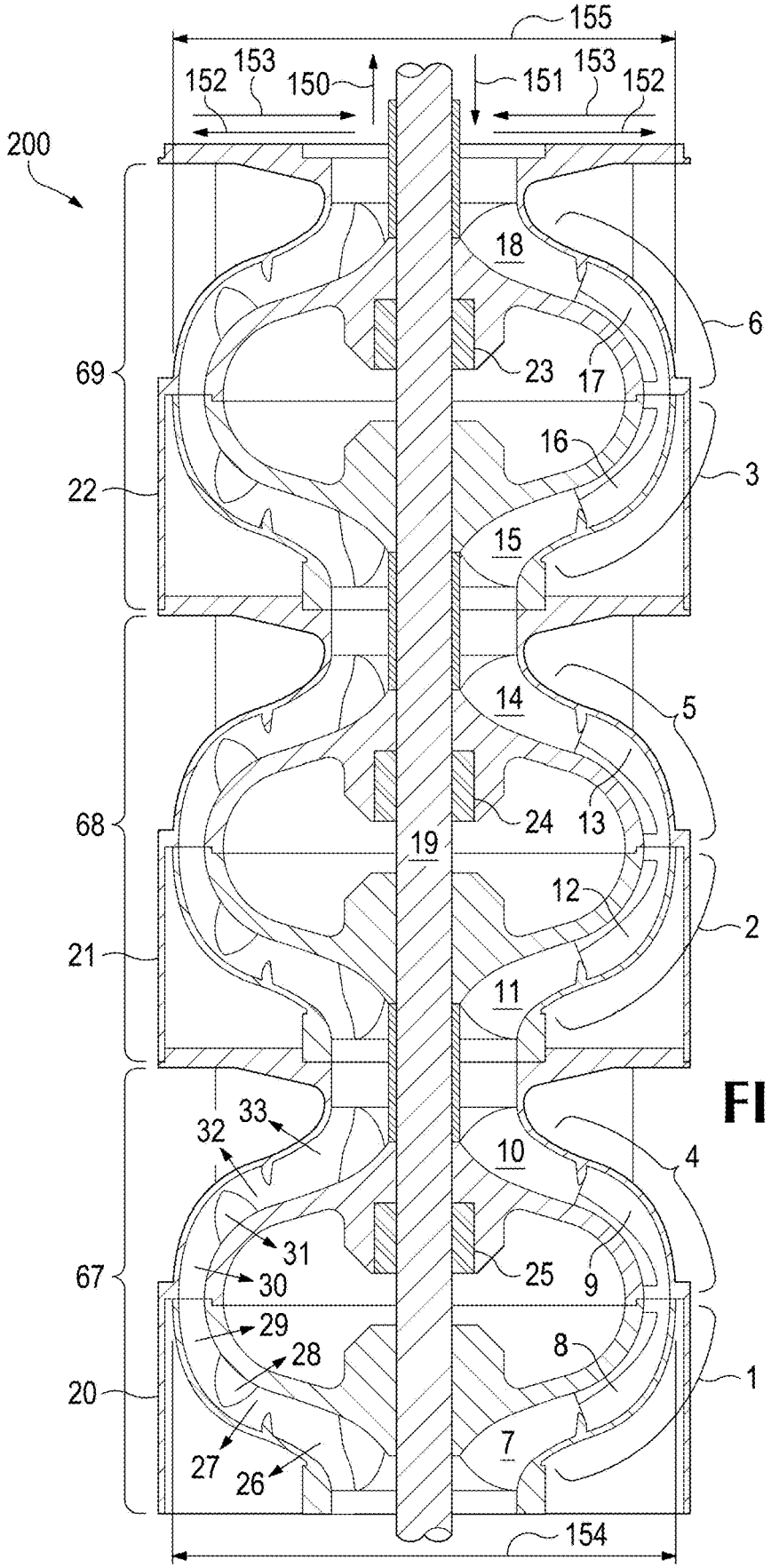
FIG. 4 is a section view of the multistage, tandem-blade-row pump of FIG. 3.

With that introduction, FIG. 3 is a cutaway view showing portions of a multistage, tandem-blade-row pump, according to an example configuration. FIG. 4 is a section view of the multistage, tandem-blade-row pump of FIG. 3. As illustrated in FIGS. 3 and 4, a multistage, tandem-blade-row pump 200 may include multiple pump stages. Specifically, FIGS. 3 and 4 illustrate a first pump stage 67, a second pump stage 68, and a third pump stage 69. The first pump stage 67 includes a first impeller stage 1 encased in a first impeller housing 20 as well as a first diffuser stage 4. The second pump stage 68 includes a second impeller stage 2 encased in a second impeller housing 21 as well as a second diffuser stage 5. The third pump stage 69 includes a third impeller stage 3 encased in a third impeller housing 22 as well as a third diffuser stage 6. While FIGS. 3 and 4 illustrate three pump stages, a tandem-blade-row pump in accordance with the disclosed technology could have more than three stages (for example, four, five, or more) or fewer than three stages (for example, one or two).

A splined shaft 19 drives each of the first pump stage 67, the second pump stage 68, and the third pump stage 69. Accordingly, the axis of rotation 86 of each of the pump stages is collinear with the shaft 19. Bearings 25 support the shaft 19 at the first pump stage 67, while bearings 24 support the shaft 19 at the second pump stage 68, and bearings 23 support the shaft 19 at the third pump stage 69. The bearing arrangement depicted in FIGS. 3 and 4 and elsewhere in this disclosure is one of many alternatives. As a result, various fluid film bearings, rolling element bearings, gas film bearings, or magnetic bearings may be used, depending on the application and depending on the fluid being pumped.

Since the structure of each of the pump stages is substantially the same, that structure is further described here with respect to the first pump stage 67.

As noted, the first pump stage 67 includes the first impeller stage 1, which operates centrifugally about the shaft 19. In the illustrated configuration, the first impeller stage 1 is encased in the first impeller housing 20. As illustrated in FIGS. 3 and 4, the first impeller stage 1 has two, separate rows of impeller blades. A first row 7 of impeller blades is configured to accept a fluid flow in a first axial direction 150, accelerate the flow on a vector 26, 27 (see discussion of FIG. 5) away from the axis of rotation 86, and discharge the flow in an outward radial direction 152 to a second row 8 of impeller blades. The first axial direction 150 is referred to in the remainder of the discussion as the forward axial direction given the direction of flow in the illustrated configurations. The second row 8 of impeller blades is configured to accept the fluid flow in the outward radial direction from the first row 7 of impeller blades, accelerate the flow on a vector 28, 29 (see discussion of FIG. 5) toward the axis of rotation 86 in an outward radial direction 153, and then accelerate the fluid in the forward axial direction 150.

As noted, the first pump stage 67 includes the first diffuser stage 4, which operates about the shaft 19 but does not rotate about the shaft 19. As illustrated in FIGS. 3 and 4, the first diffuser stage has two rows of diffuser blades. A first row 9 of diffuser blades is configured to receive the flow from the first impeller stage 1, accelerate the flow in the forward axial direction 150, and then accelerate the flow on a vector 30, 31 (see discussion of FIG. 5) toward the axis of rotation 86. A second row 10 of diffuser blades is configured to accept the flow in the inward radial direction from the first row 9 of diffuser blades, first accelerate the flow on a vector 32, 33 (see discussion of FIG. 5) away from the axis of rotation 86, then accelerate the fluid in the forward axial direction 150, and then discharge the fluid from the first diffuser stage 4 in the forward axial direction 150. In configurations having multiple pump stages, such as illustrated in FIGS. 3 and 4, the second row 10 of diffuser blades is configured to discharge the fluid from the first diffuser stage 4 into the second impeller stage 2.

Figure 5:
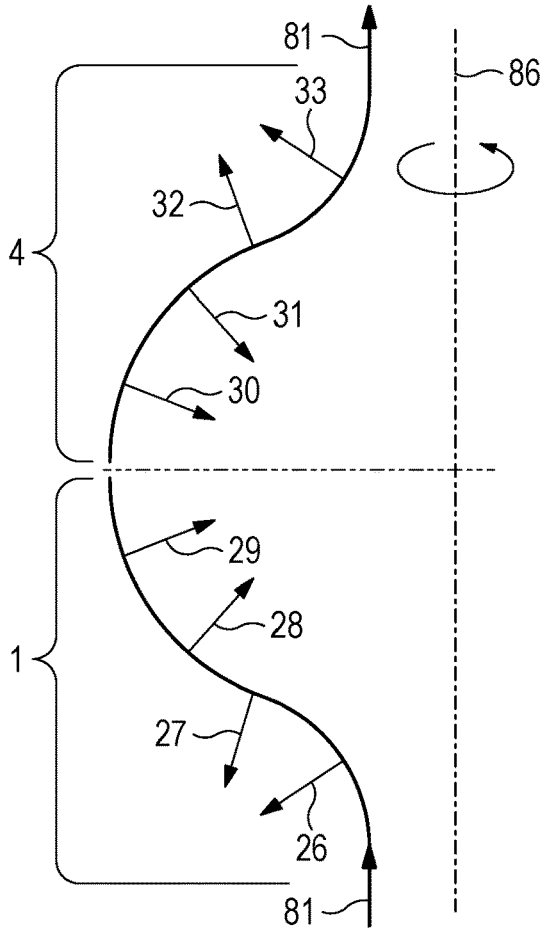
FIG. 5 is a schematic of a streamline through one stage of the multistage, tandem-blade-row pump of FIGS. 3-4.

FIG. 5 is a schematic of a streamline through the first pump stage 67 of the multistage, tandem-blade-row pump of FIGS. 3-4. As illustrated in FIGS. 4 and 5, acceleration vectors within the meridional plane are identified by reference numbers 26-33. Specifically, accelerations of the fluid flow caused by the first row 7 of impeller blades of the first impeller stage 1 are represented by outward vector 26 and outward vector 27. Accelerations of the fluid flow caused by the second row 8 of impeller blades of the first impeller stage 1 are represented by inward vector 28 and inward vector 29. The second row 8 of impeller blades of the first impeller stage 1 continue the same acceleration normal to the meridional plane as the first row 7 of impeller blades, while imparting an opposite acceleration as indicated by the inward vector 28 and the inward vector 29. As discussed above for FIGS. 3 and 4, the different net acceleration vectors are preferably accomplished with separate blade rows, which benefit from freshly energized boundary layers that are less prone to flow separation than would be continuous but severely twisted blades configured to impart the conflicting accelerations illustrated in FIG. 5.

Similarly, accelerations of the fluid flow caused by the first row 9 of diffuser blades of the first diffuser stage 4 are represented by inward vector 30 and inward vector 31. Accelerations of the fluid flow caused by the second row 10 of diffuser blades of the first diffuser stage 4 are represented by outward vector 32 and outward vector 33. In other words, the flow must first be accelerated toward the shaft centerline, but before it gets there, its inward velocity must be reduced so that, when it reaches the impeller eye of the subsequent pump stage, its flow direction is axial and in alignment with the eye of that subsequent impeller. The direction of axial acceleration is indicated by the vector 81 in FIG. 5. As with the first impeller stage 1, the different net acceleration vectors illustrated for the first diffuser stage 4 are similarly preferably accomplished with separate blade rows for the reasons noted for the first diffuser stage 4.

While not separately illustrated, the accelerations for the other stages are substantially the same as what is described for FIG. 5 for the first pump stage 67.

Figure 6:
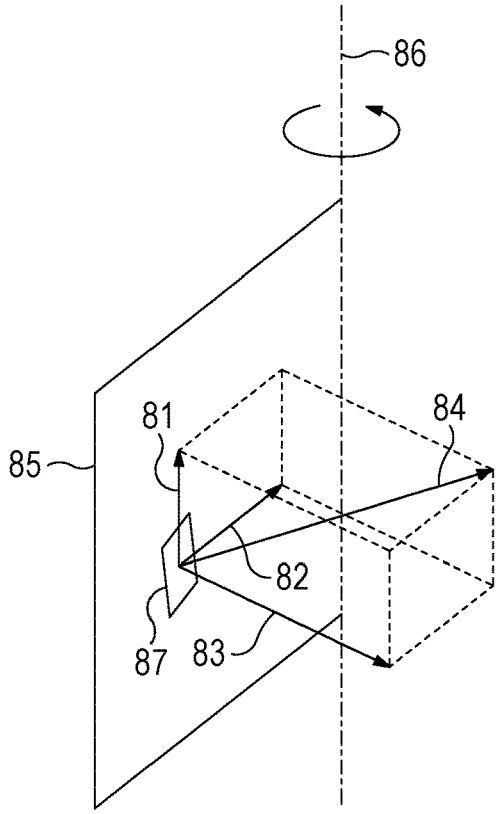
FIGS. 6 and 7 illustrate example acceleration vectors relative to the blade angle.
Figure 7:
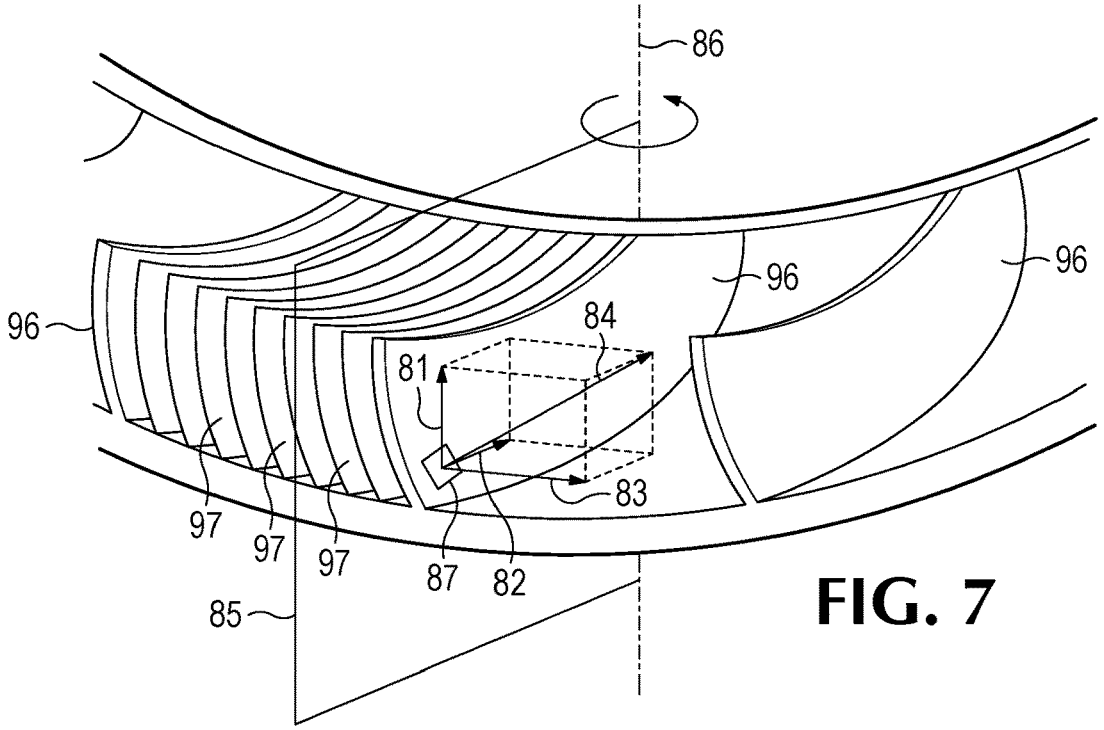

FIGS. 6 and 7 illustrate example acceleration vectors imparted to the fluid flow by the impeller blades 96 such as, for example, blades in the first row 7 of impeller blades of the first impeller stage 1. As illustrated in FIGS. 6 and 7, the blade surface 87 imparts a net acceleration 84 to the fluid flow as the blade surface 87 rotates around the axis of rotation 86. The net acceleration 84 is oriented normal to the blade surface 87 and is comprised of a radial acceleration component 82 and an axial acceleration component 81, both in the meridional plane 85, as well as a tangential component 83. The accelerations within the meridional plane and serve to guide the fluid flow within the meridional plane, while the tangential component 83 imparts energy to the fluid flow (in the case of a pump or compressor). While the required direction of acceleration in the meridional plane reverses (e.g. from outward to inward, or vice versa), the tangential acceleration 83 is maintained to achieve the design head for the particular stage. Analogous accelerations and decelerations are imparted to the fluid flow by the diffuser blades. With particular reference to FIG. 7, configuring the surfaces of blades 96 to be parallel to isobars 97 maximizes the minimum pressure for a given blade loading and thus optimizes cavitation performance.

Returning to FIGS. 3 and 4, as illustrated, the second impeller stage 2 operates centrifugally about the shaft 19. The second impeller stage 2 has two rows of impeller blades. A first row 11 of impeller blades of the second impeller stage 2 is configured to accept the fluid flow from the first diffuser stage 4, accelerate the flow on a vector away from the axis of rotation 86, and discharge the flow in the outward radial direction to a second row 12 of impeller blades of the second impeller stage 2. The second row 12 of impeller blades of the second impeller stage 2 is configured to accept the flow in the outward radial direction from the first row 11 of impeller blades of the second impeller stage 2, first accelerate the flow on a vector toward the axis of rotation 86 in the inward radial direction, and then accelerate the fluid in the forward axial direction 150.

As illustrated in FIGS. 3 and 4, the second diffuser stage 5 operates about the shaft 19 but does not rotate about the shaft 19. The second diffuser stage 5 has two rows of diffuser blades. A first row 13 of diffuser blades of the second diffuser stage 5 is configured to receive the flow from the second impeller stage 2, first accelerate the flow in the forward axial direction 150, and then accelerate the flow in on a vector toward the axis of rotation 86. A second row 14 of diffuser blades of the second diffuser stage 5 is configured to accept the flow in the inward radial direction 153 from the first row 13 of diffuser blades of the second diffuser stage 5, first accelerate the flow on a vector away from the axis of rotation 86, then accelerate the fluid in the forward axial direction 150, and then discharge the fluid from the second diffuser stage 5 in the forward axial direction 150.

As illustrated in FIGS. 3 and 4, the third impeller stage 3 operates centrifugally about the shaft 19. The third impeller stage 3 has two rows of impeller blades. A first row 15 of impeller blades of the third impeller stage 3 is configured to accept the fluid flow from the second diffuser stage 5, accelerate the flow on a vector away from the axis of rotation 86, and discharge the flow in the outward radial direction to a second row 16 of impeller blades of the third impeller stage 3. The second row 16 of impeller blades of the third impeller stage 3 is configured to accept the flow in the outward radial direction from the first row 15 of impeller blades of the third impeller stage 3, first accelerate the flow on a vector toward the axis of rotation 86 in the inward radial direction, and then accelerate the fluid in the forward axial direction 150.

As illustrated in FIGS. 3 and 4, the third diffuser stage 6 operates about the shaft 19 but does not rotate about the shaft 19. The third diffuser stage 6 has two rows of diffuser blades. A first row 17 of diffuser blades of the third diffuser stage 6 is configured to receive the flow from the third impeller stage 3, first accelerate the flow in the forward axial direction 150, and then accelerate the flow in on a vector toward the axis of rotation 86. A second row 18 of diffuser blades of the third diffuser stage 6 is configured to accept the flow in the inward radial direction 153 from the first row 17 of diffuser blades of the third diffuser stage 6, first accelerate the flow on a vector away from the axis of rotation 86, then accelerate the fluid in the forward axial direction 150, and then discharge the fluid from the third diffuser stage 6 in the forward axial direction 150.

Each impeller stage and each diffuser stage has an outer diameter. For clarity, these diameters are illustrated in FIG. 4 just for the first impeller stage 1 and the third diffuser stage 6. In configurations, the outer diameter 154 of the impeller stage is not larger than the outer diameter 155 of the corresponding diffuser stage. In configurations, the outer diameter 154 of the impeller stage is substantially equal to the outer diameter 155 of the corresponding diffuser stage. As used in this context, "substantially equal" means largely or essentially equivalent, without requiring perfect identicalness.

Computational fluid dynamics (CFD) solutions for the pump configuration of FIGS. 3 and 4 illustrate a calculated efficiency in excess of 90%. This favorable calculated efficiency is consistent with the relative absence of secondary flows and absence of flow separation attributable to the tandem-blade configuration.

The multistage, tandem-blade-row pump 200 described above for FIGS. 3 and 4 can be made shorter by axially flattening each impeller stage and each diffuser stage. Doing so introduces a third acceleration zone (with less acceleration within the meridional plane), which is preferably handled with a third blade row that is between the two blade rows described for the tandem-blade-row pump 200.

Figure 8:
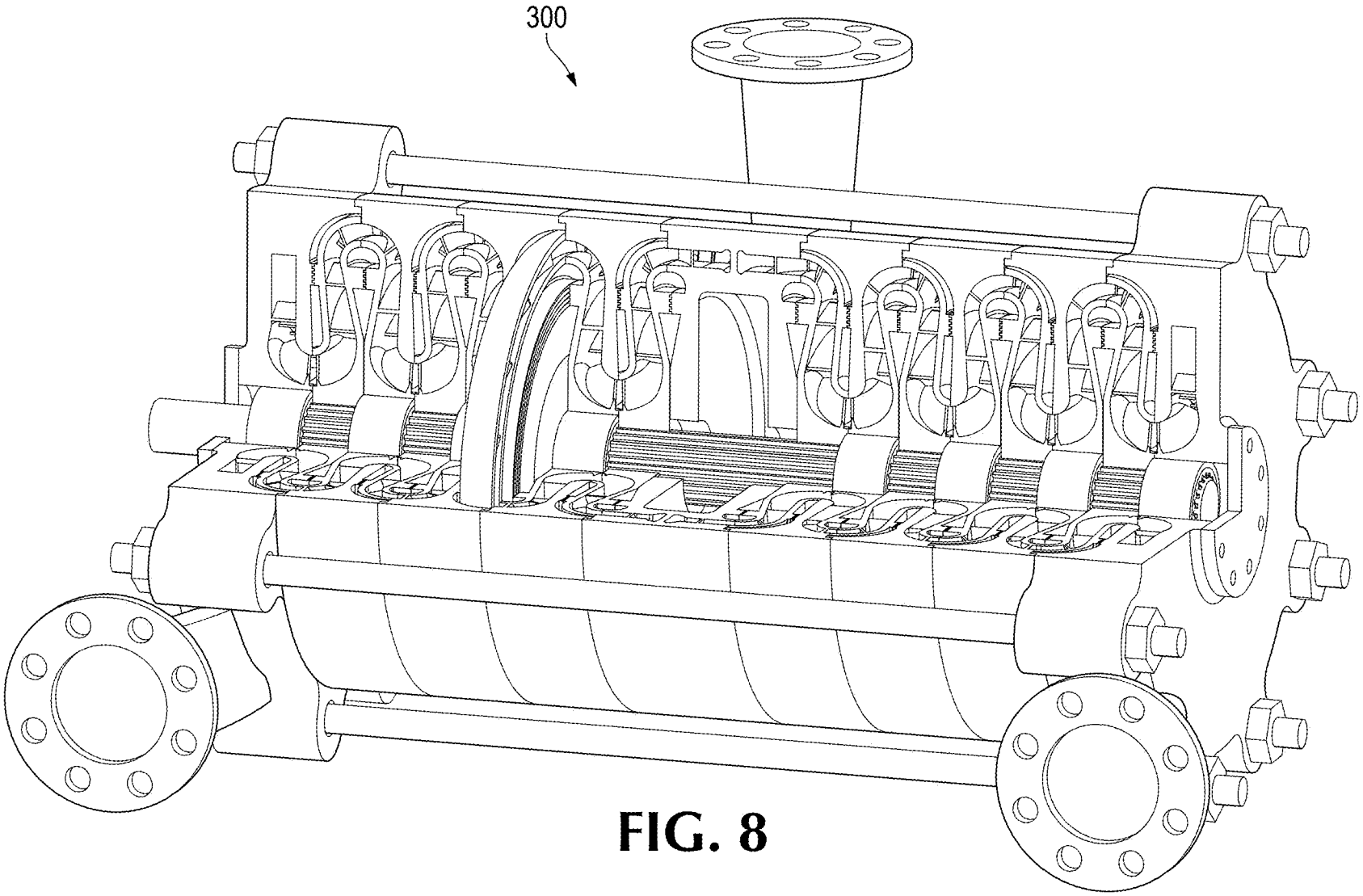
FIG. 8 is a quarter section view of a multistage, triple-blade-row pump, according to an example configuration.
Figure 9:
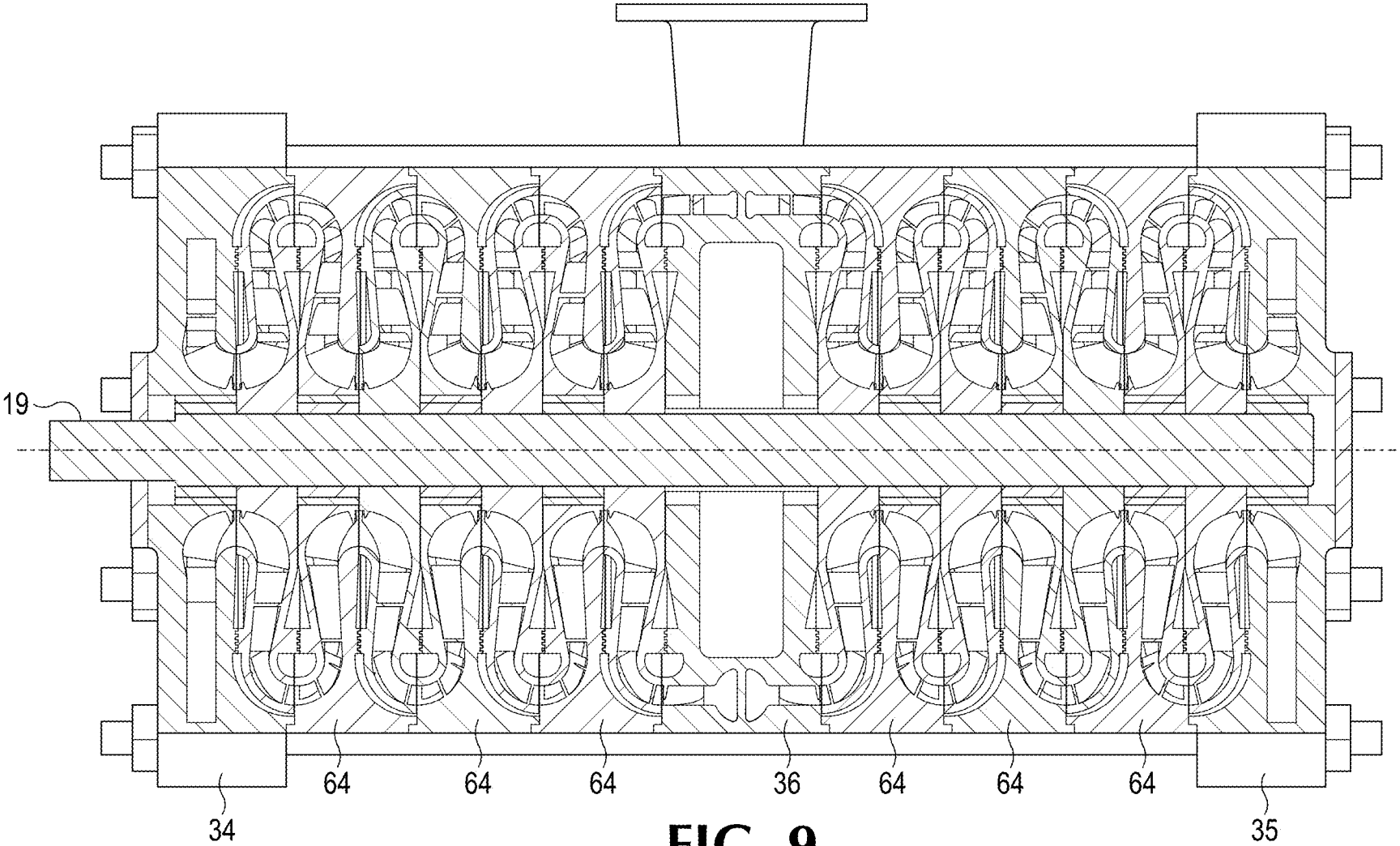
FIG. 9 is a section view of the multistage, triple-blade-row pump of FIG. 8.
Figure 10:
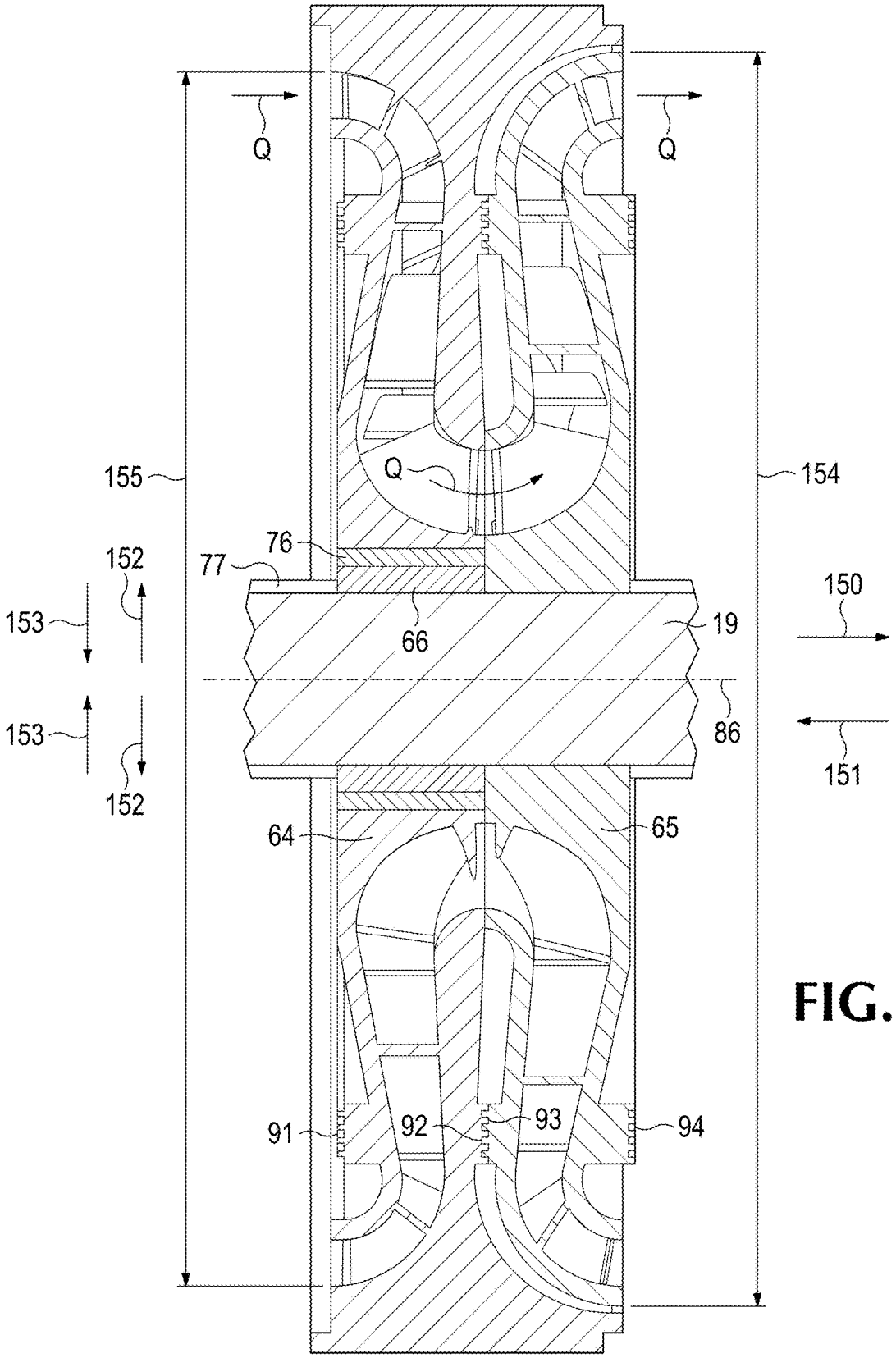
FIG. 10 illustrates one example stage of the multistage, triple-blade-row pump of FIG. 8.
Figure 11:
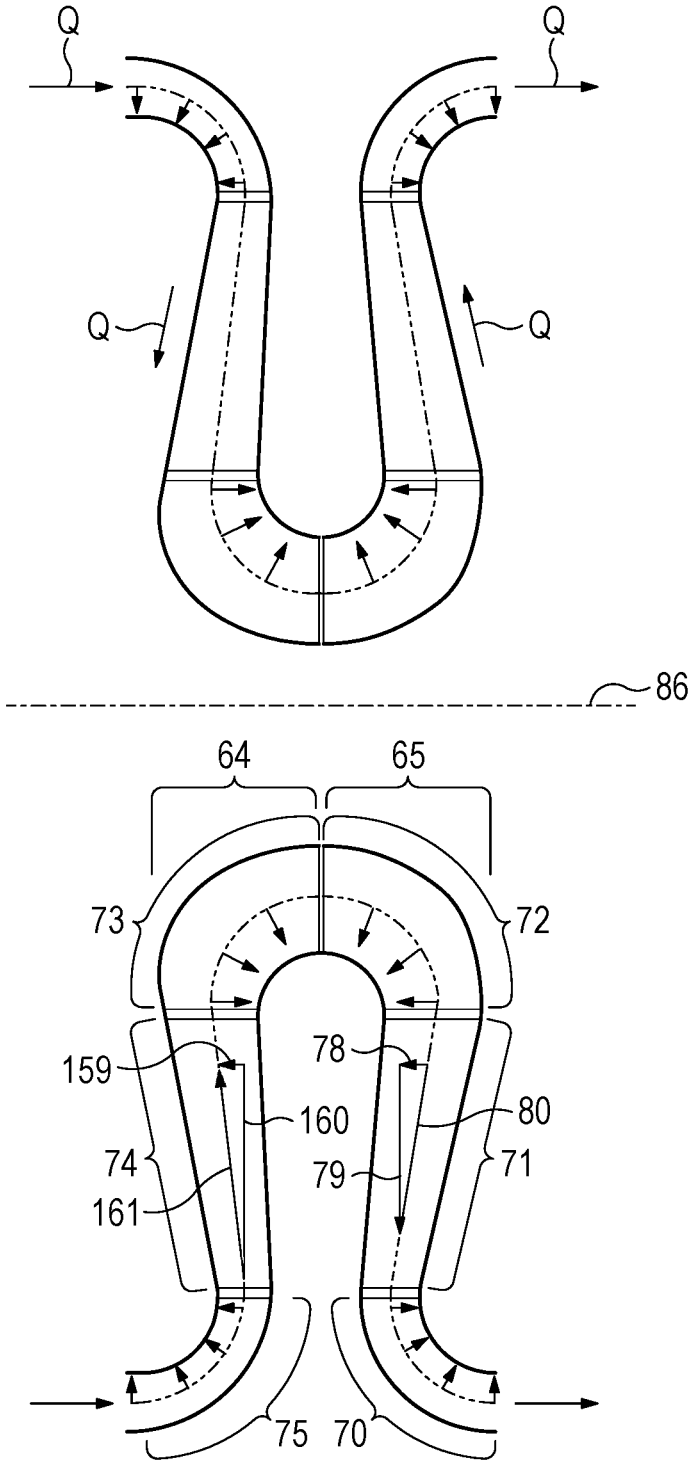
FIG. 11 is a schematic of a streamline through the stage of FIG. 10.

FIG. 8 is a quarter-section view illustrating portions of a multistage, triple-blade-row pump, according to an example configuration. FIG. 9 is a section view of the multistage, triple-blade-row pump of FIG. 8. FIG. 10 illustrates one example stage of the multistage, triple-blade-row pump of FIG. 8. FIG. 11 is a schematic of a streamline through the stage of FIG. 10. As illustrated in FIGS. 8-11, a multistage, triple-blade-row pump 300 may include multiple pump stages, each having a diffuser stage 64 and an impeller stage 65. The shaft 19 drives each of the pump stages, and the axis of rotation 86 of each of the pump stages is collinear with the shaft 19. As illustrated, fluid enters the pump stages through inlet manifold 34 or inlet manifold 35 and exits the pump stages through outlet manifold 36.

Since each diffuser stage 64 is substantially identical, and since each impeller stage 65 is substantially identical, these are described below by representative examples.

With particular reference to FIGS. 10 and 11, a centrifugal impeller stage 65 is configured to rotate about the axis of rotation 86. The impeller stage 65 has three, separate rows of impeller blades. A first row 72 of impeller blades is configured to accept a fluid flow Q in a forward axial direction 150, such as from an inlet manifold or a preceding pump stage's diffuser stage. The first row 72 of impeller blades is configured accelerate the flow Q on a vector away from the axis of rotation 86, and discharge the fluid flow Q in an outward radial direction 152 to a second row 71 of impeller blades. Accordingly, the first row 72 of impeller blades changes the flow direction in the meridional plane from axial to radially outward while also imparting a tangential acceleration. The second row 71 of impeller blades is configured to accelerate the flow Q in the outward radial direction 152 by a impeller radial-velocity component 79 and also to accelerate the flow Q in a second axial direction 151 by an impeller axial-velocity component 78. The second axial direction 151 is opposite to the first axial direction 150. The second axial direction 151 is referred to in the remainder of the discussion as the reverse axial direction 151 given the direction of flow in the illustrated configurations. In configurations, the axial velocity component may be for example, less than 10% the value of the radial velocity component. The second row 71 of impeller blades maintains the impeller flow direction 80 within the meridional plane in the generally radially outward direction, the impeller flow direction 80 being made up of impeller radial-velocity component 79 and impeller axial-velocity component 78. A third row 70 of impeller blades is configured to accept the flow Q in the outward radial direction 152 from the second row 71 of impeller blades, first accelerate the flow Q on a vector toward the axis of rotation 86 in an inward radial direction 153, and then accelerate the fluid flow Q in the forward axial direction 150. Accordingly, the third row 70 of impeller blades continues imparting kinetic energy to the fluid flow Q while also imparting an acceleration within the meridional plane so as to discharge the flow axially to the subsequent diffuser stage 64.

Hence, the velocity of the flow Q exiting the second row 71 of impeller blades is nominally radial within the meridional plane. But a moderate impeller axial-velocity component 78, which is parallel to the axis of rotation 86, reduces the length of each pump stage, and in turn reduces the overall length of the stacked pump stages. The close axial spacing of the pump stages increases shaft critical speed, reduces required shaft diameter, reduces bearing sizes, reduces bearing losses, and reduces overall pump size, weight, and cost.

As a result, the change in meridional plane flow direction within the impeller stage 65 is achieved efficiently with minimal flow separation and minimal generation of secondary flows. Also, importantly, the fluid has remained in the impeller stage 65 until the last possible moment, while being carried to the largest possible radius, without the requirement for a larger diameter impeller and without the requirement for a diffuser any larger than the impeller. Efficiency has thus been increased while size, weight, and manufacturing cost have been reduced. This concept can be extended to any number of blade rows used per impeller stage and diffuser stage.

A diffuser stage 64 is about the axis of rotation 86 but does not rotate about the axis of rotation 86. The diffuser stage 64 has three rows of diffuser blades. A first row 75 of diffuser blades is configured to receive the flow Q from the previous impeller stage 65, first accelerate the flow Q in the forward axial direction 150, and then accelerate the flow Q on a vector toward the axis of rotation 86. A second row 74 of diffuser blades is configured to accelerate the flow in the inward radial direction 153 by a diffuser radial-velocity component 160 and also to accelerate the flow Q in the reverse axial direction 151 by the diffuser axial-velocity component 159. Hence, the diffuser flow direction 161 within the meridional plane is made up of diffuser radial-velocity component 160 and diffuser axial-velocity component 159. A third row 73 of diffuser blades is configured to accept the flow Q in the inward radial direction 153 from the second row 74 of diffuser blades, first accelerate the flow Q on a vector away from the axis of rotation 86, then accelerate the fluid flow Q in the forward axial direction 150, and then discharge the fluid flow Q from the diffuser stage 64 in the forward axial direction 150. In configurations having multiple stages, the third row 73 of diffuser blades discharge the fluid flow Q from the diffuser stage 64 into a second impeller stage 65. The second impeller stage 65 may have a corresponding second diffuser stage 64, as illustrated in FIGS. 8 and 9.

Hence, as with the impeller stage 65, each diffuser stage 64 may be similarly reduced in length by adding the impeller axial-velocity component 78 to the mean meridional plane streamline within the second row 74 of diffuser blades. This reduces the stage-to-stage spacing while allowing hydraulically efficient bend radii at the third row 70 of impeller blades and the first row 72 of impeller blades and at the third row 73 of diffuser blades and the first row 75 of diffuser blades.

With particular reference to FIG. 10, each impeller stage 65 and each diffuser stage 64 has an outer diameter. In configurations, the outer diameter 154 of the impeller stage 65 is not larger than the outer diameter 155 of the corresponding diffuser stage 64. In configurations, the outer diameter 154 of the impeller stage 65 is substantially equal to the outer diameter 155 of the corresponding diffuser stage 64. As used in this context, "substantially equal" means largely or essentially equivalent, without requiring perfect identicalness.

Still referring primarily to FIG. 10, the shaft 19 is splined and drives the impeller stage 65 via the spline 77. Internally splined bushing 66 rotates with the shaft 19 and is hydrodynamically supported by a bearing 76 that is mounted within the (non-rotating) diffuser stage 64. A number of such impeller-diffuser pairs may be stacked together with the impellers stages 65 being driven by a common shaft 19. Sealing between the impeller stages 65 and the diffuser stages 64 can be achieved with labyrinth seals 91, 92, 93 and 94 or other sealing options. Thrust forces may optionally be balanced by assembling on a common shaft an equal number of clockwise and counter-clockwise rotating (when viewed from the inlet, for example) impeller stages with corresponding diffuser stages. A salient feature of the disclosed technology is that the diffuser stages need not be any larger in diameter than the impeller stages (or runners in the case of a turbine). Achieving the small diffuser diameter is enabled by turning within the meridional plane the nominally radial outward flow in the impeller stage to axial flow before handing off the flow to the diffuser stage.

Figure 12:
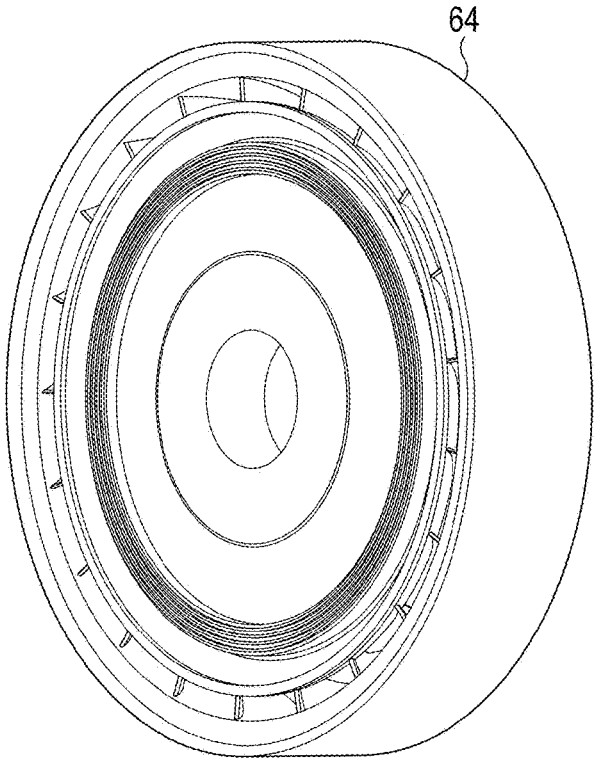
FIG. 12 is an isometric view of a first side of the triple-blade-row diffuser stage of FIG. 10 in isolation.
Figure 13:
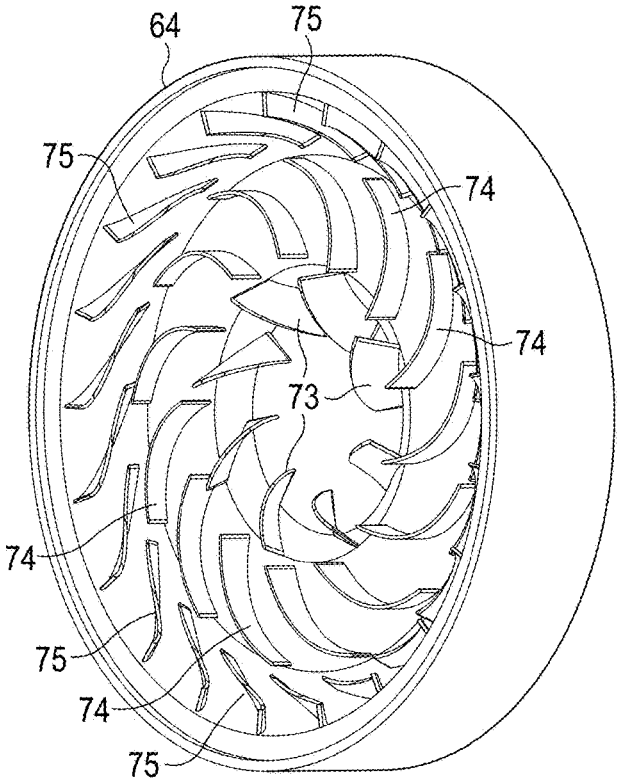
FIG. 13 is an isometric view of a second side of the triple-blade-row diffuser stage of FIG. 10 in isolation.

FIG. 12 is an isometric view of a first side of the triple-blade-row diffuser stage of FIG. 10 in isolation. FIG. 13 is an isometric view of a second side of the triple-blade-row diffuser stage of FIG. 10 in isolation. The diffuser stage 64 of FIGS. 12 and 13 is as described above for FIGS. 8-11.

Figure 14:
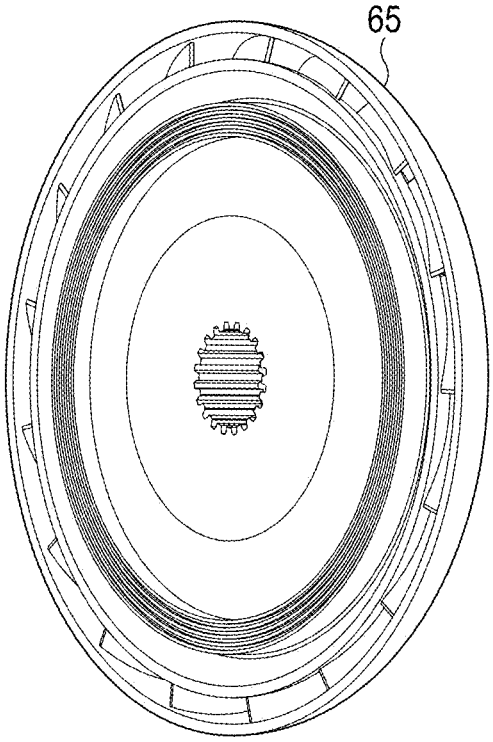
FIG. 14 is an isometric view of a first side of the triple-blade-row impeller stage of FIG. 10 in isolation.
Figure 15:
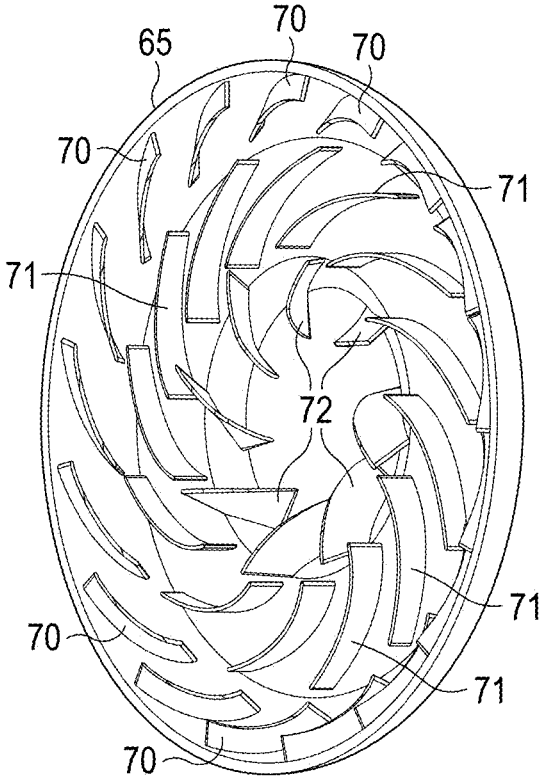
FIG. 15 is an isometric view of a second side of the triple-blade-row impeller stage of FIG. 10 in isolation.

FIG. 14 is an isometric view of a first side of the triple-blade-row impeller stage of FIG. 10 in isolation. FIG. 15 is an isometric view of a second side of the triple-blade-row impeller stage of FIG. 10 in isolation. The impeller stage 65 of FIGS. 14 and 15 is as described above for FIGS. 8-11.

Figure 16:
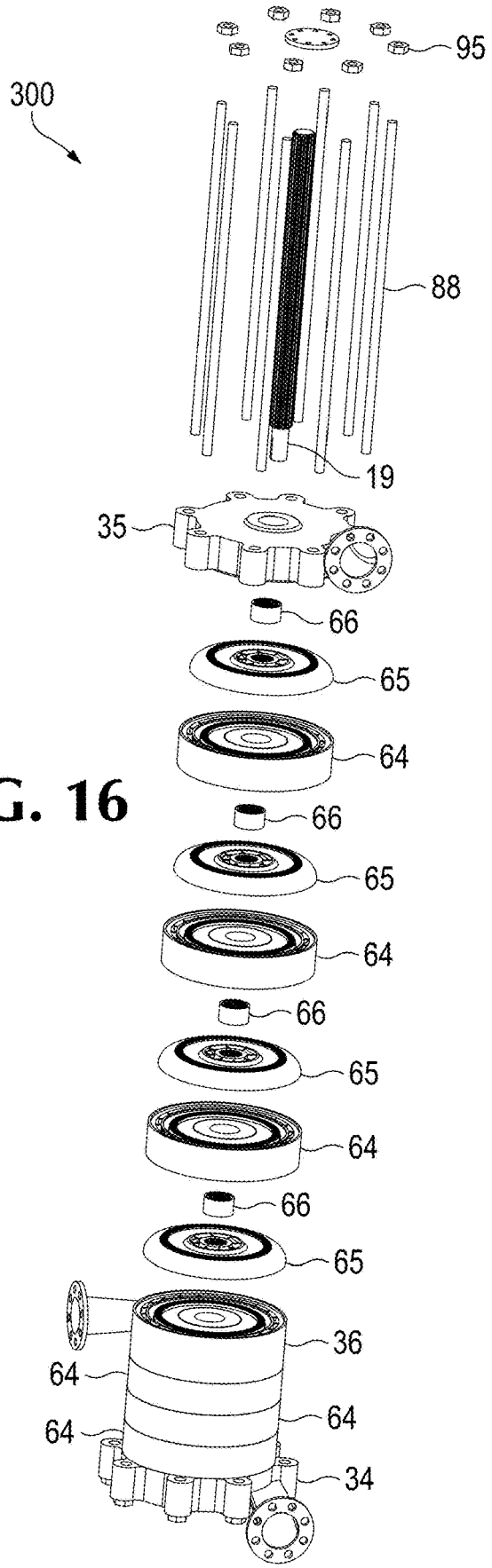
FIG. 16 is an exploded view of the multistage, triple-blade-row pump of FIG. 8.
Figure 17:
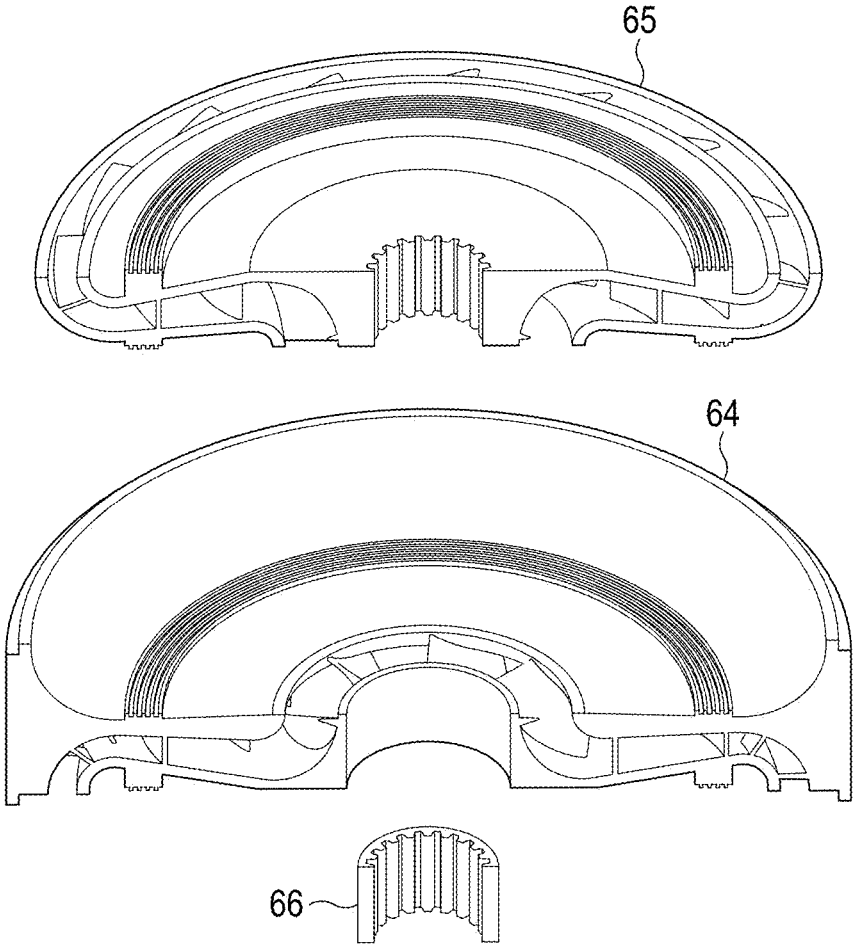
FIG. 17 is an axial section, exploded view of the triple-blade-row impeller stage of FIG. 10, the triple-blade-row diffuser stage of FIG. 10, and an example of an internally splined bushing.

FIG. 16 is an exploded view of the multistage, triple-blade-row pump of FIG. 8. FIG. 17 is an axial section, exploded view of the triple-blade-row impeller stage of FIG. 10, the triple-blade-row diffuser stage of FIG. 10, and an example of an internally splined bushing 66. The labeled components are as described above for FIGS. 8-15. In addition, internally splined bushing 66 rotates with shaft 19 within the central gap of the diffuser stage 64. The components are held together by tie rods 88 and nuts 95.

Figure 18:
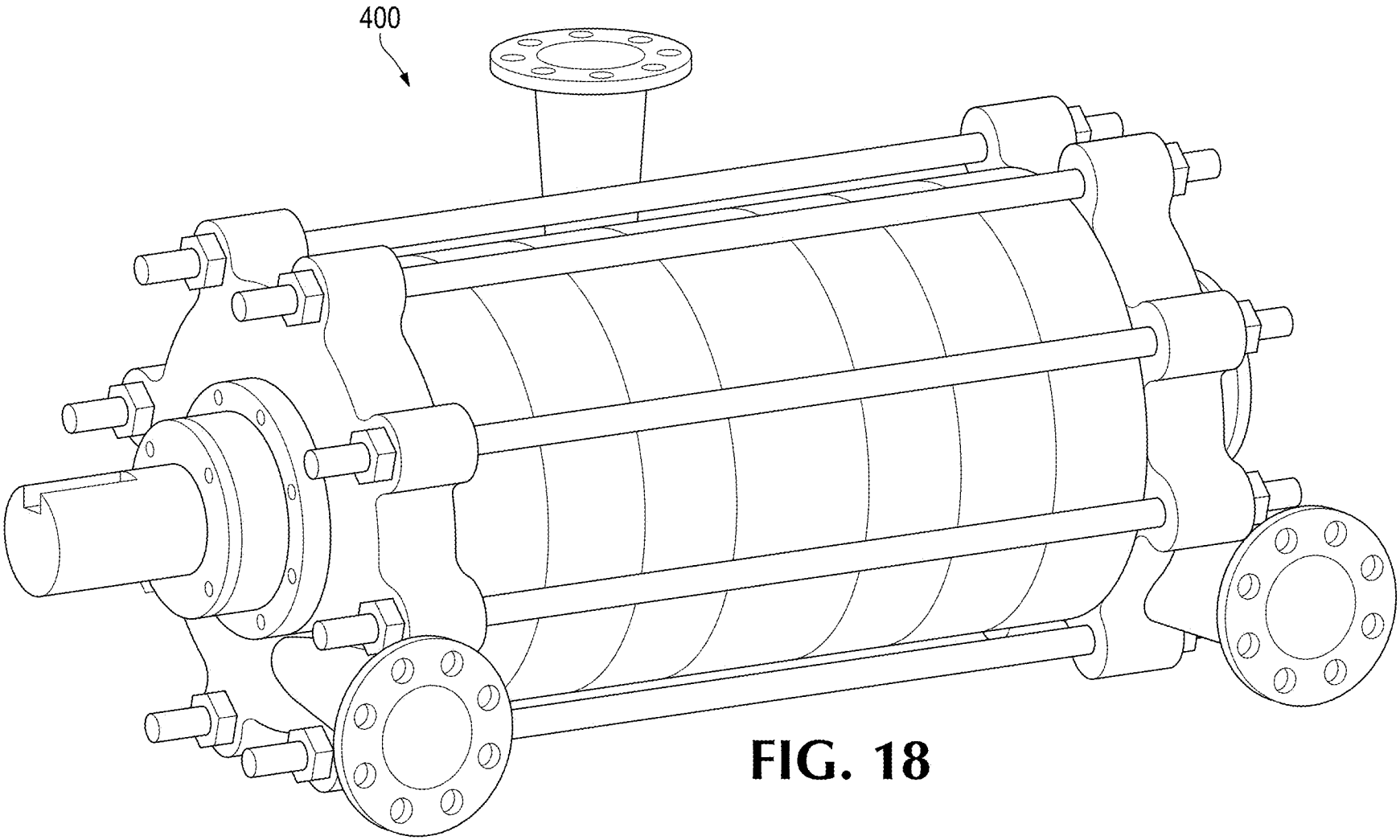
FIG. 18 is a perspective view of a multistage, multi-blade-row pump, illustrating an example of an open-blade-row impeller according to an example configuration.
Figure 19:
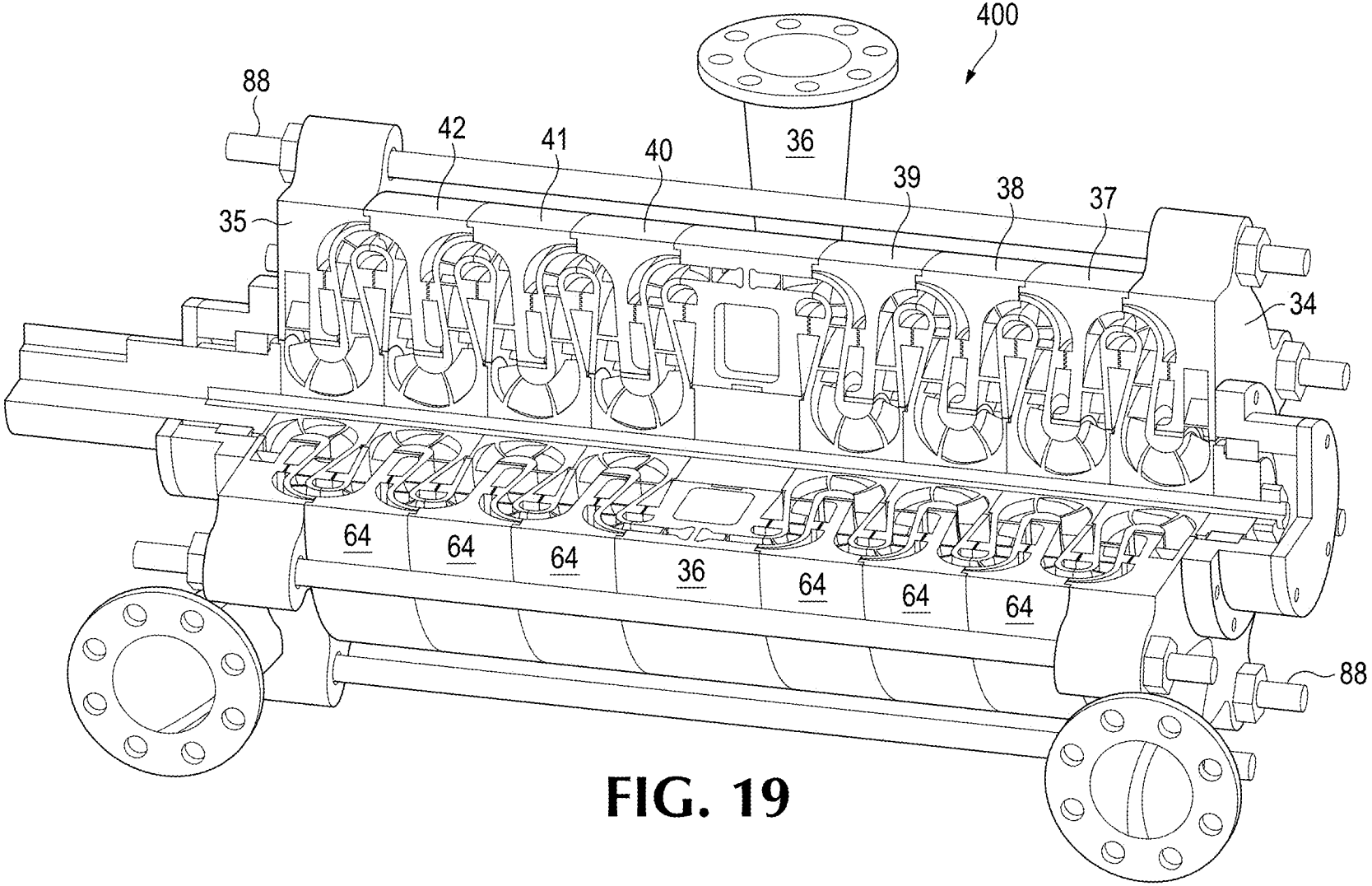
FIG. 19 is a quarter section view of the multistage, multi-blade-row pump of FIG. 18.
Figure 20:
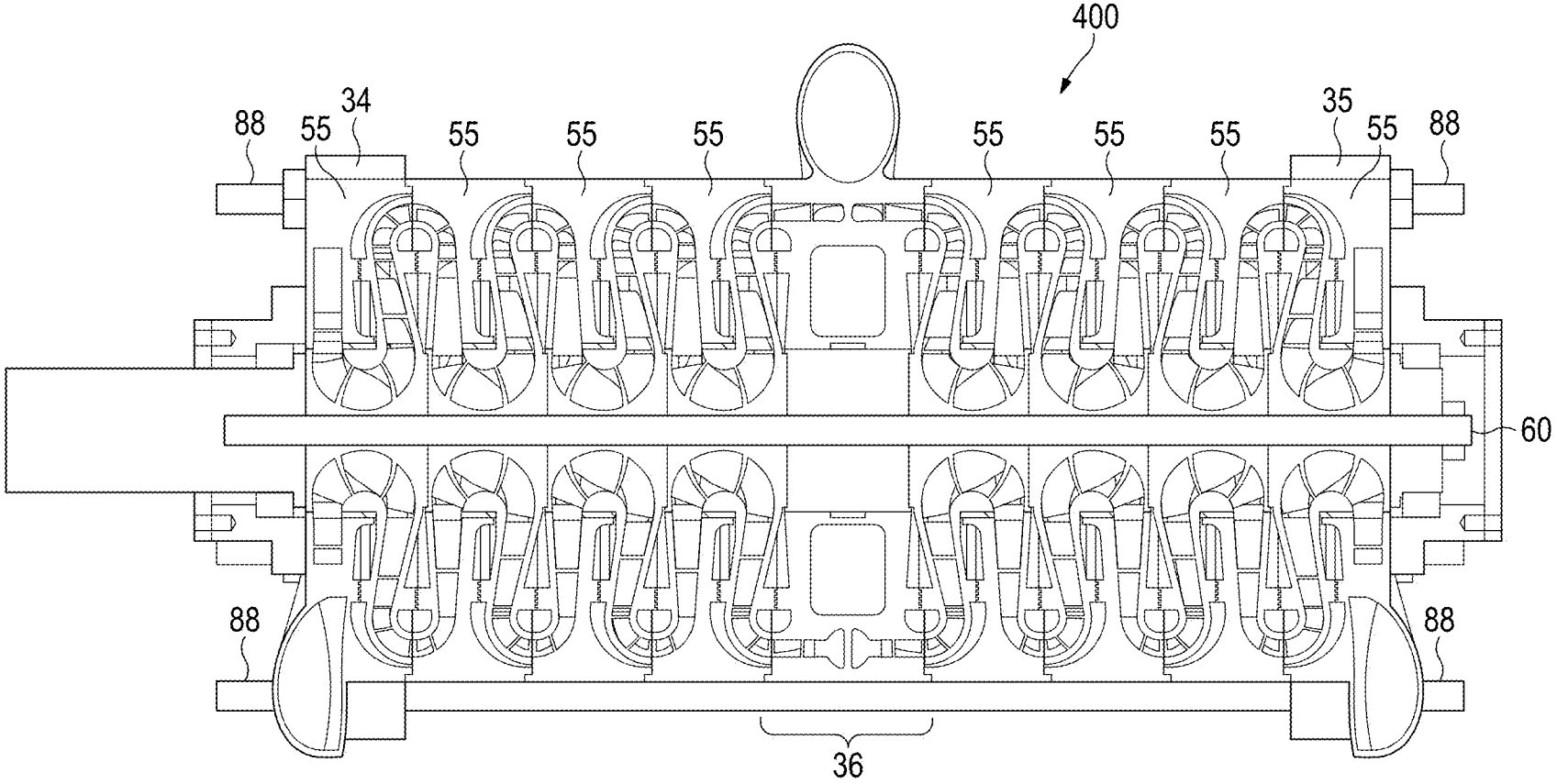
FIG. 20 is a section view of the multistage, multi-blade-row pump of FIG. 18.
Figure 21:
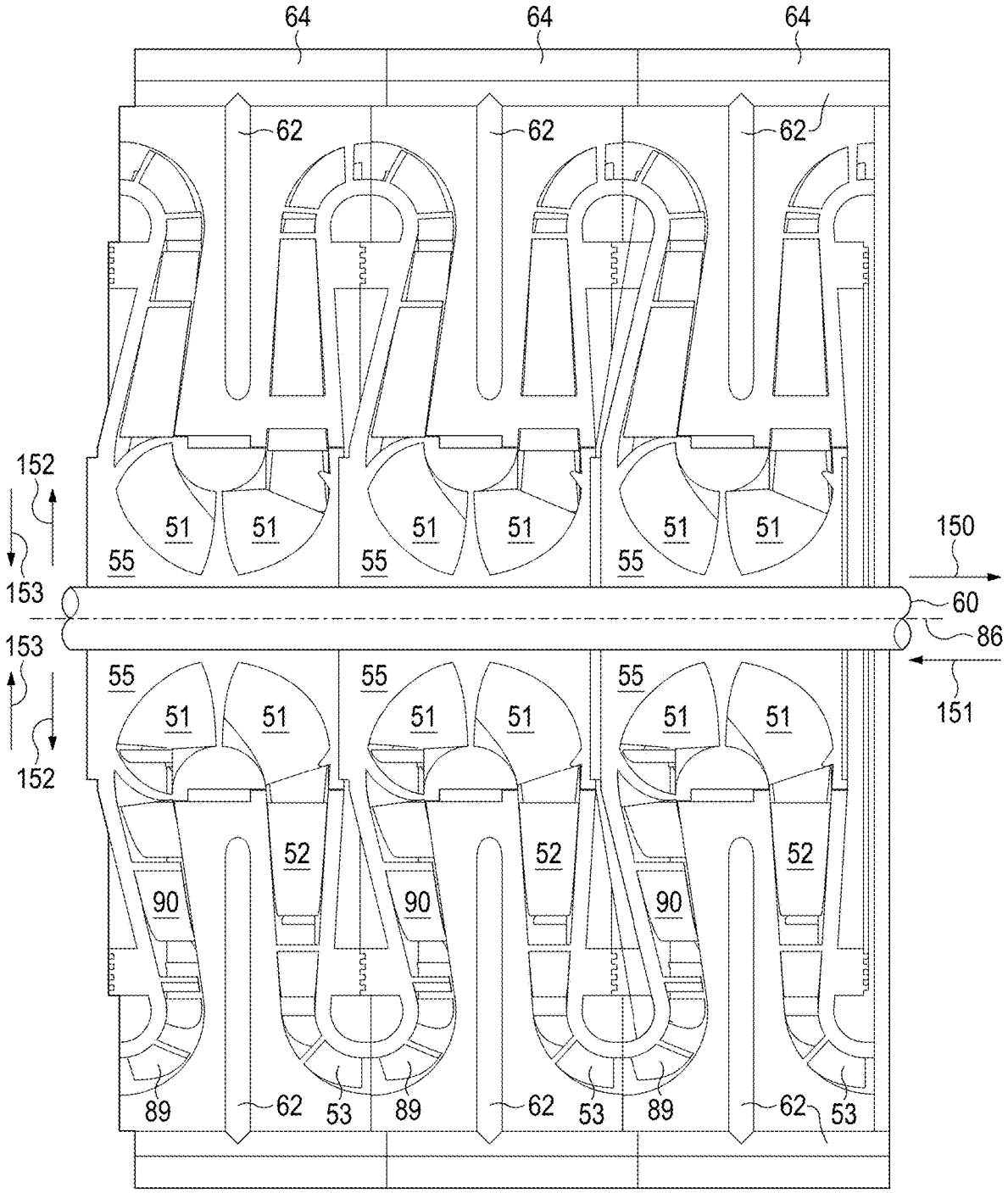
FIG. 21 is a section view of three stages of the multistage, multi-blade-row pump of FIG. 18.
Figure 22:
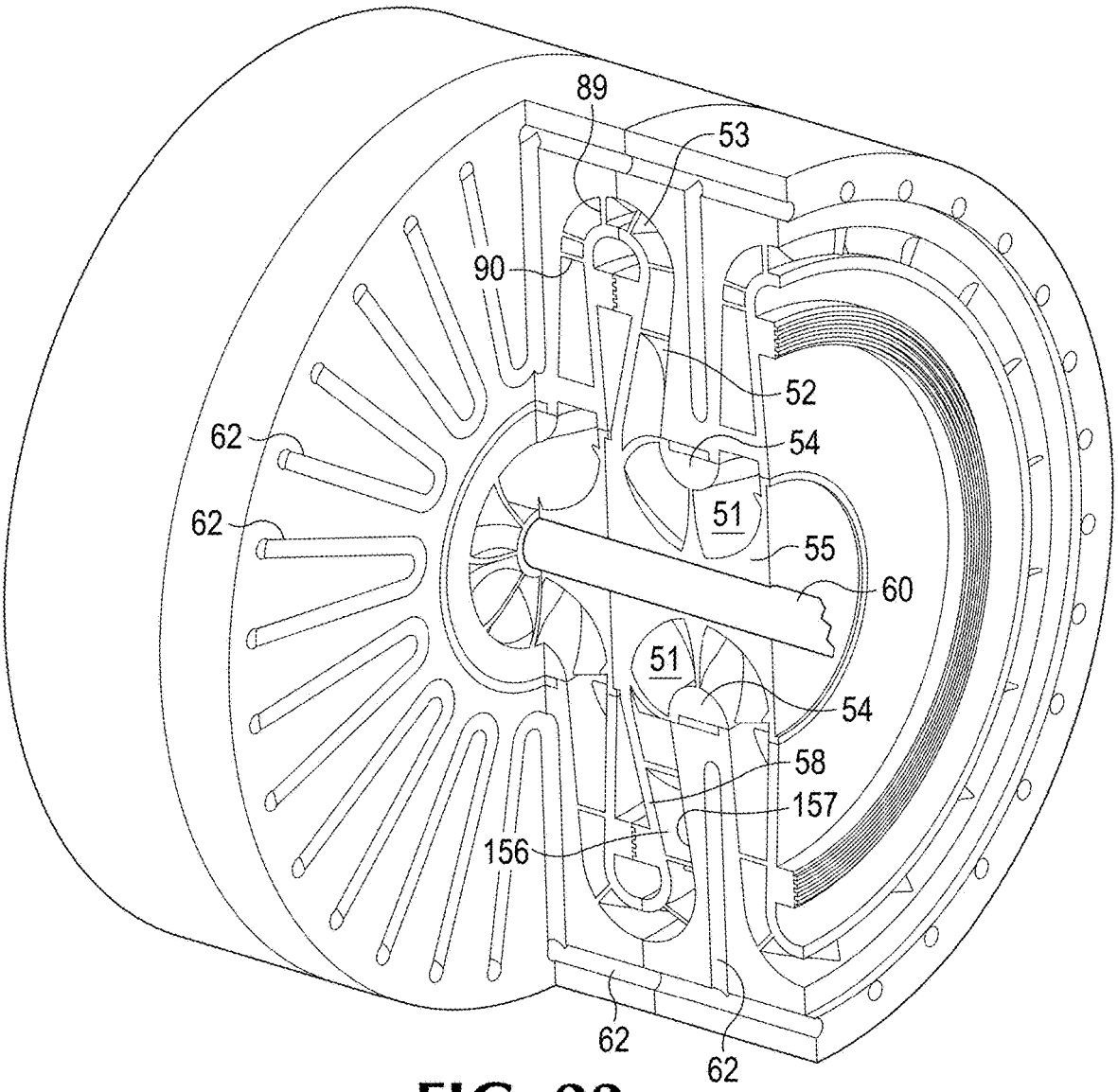
FIG. 22 is a partial section view of a portion of the multistage, multi-blade-row pump of FIG. 18.
Figure 23:
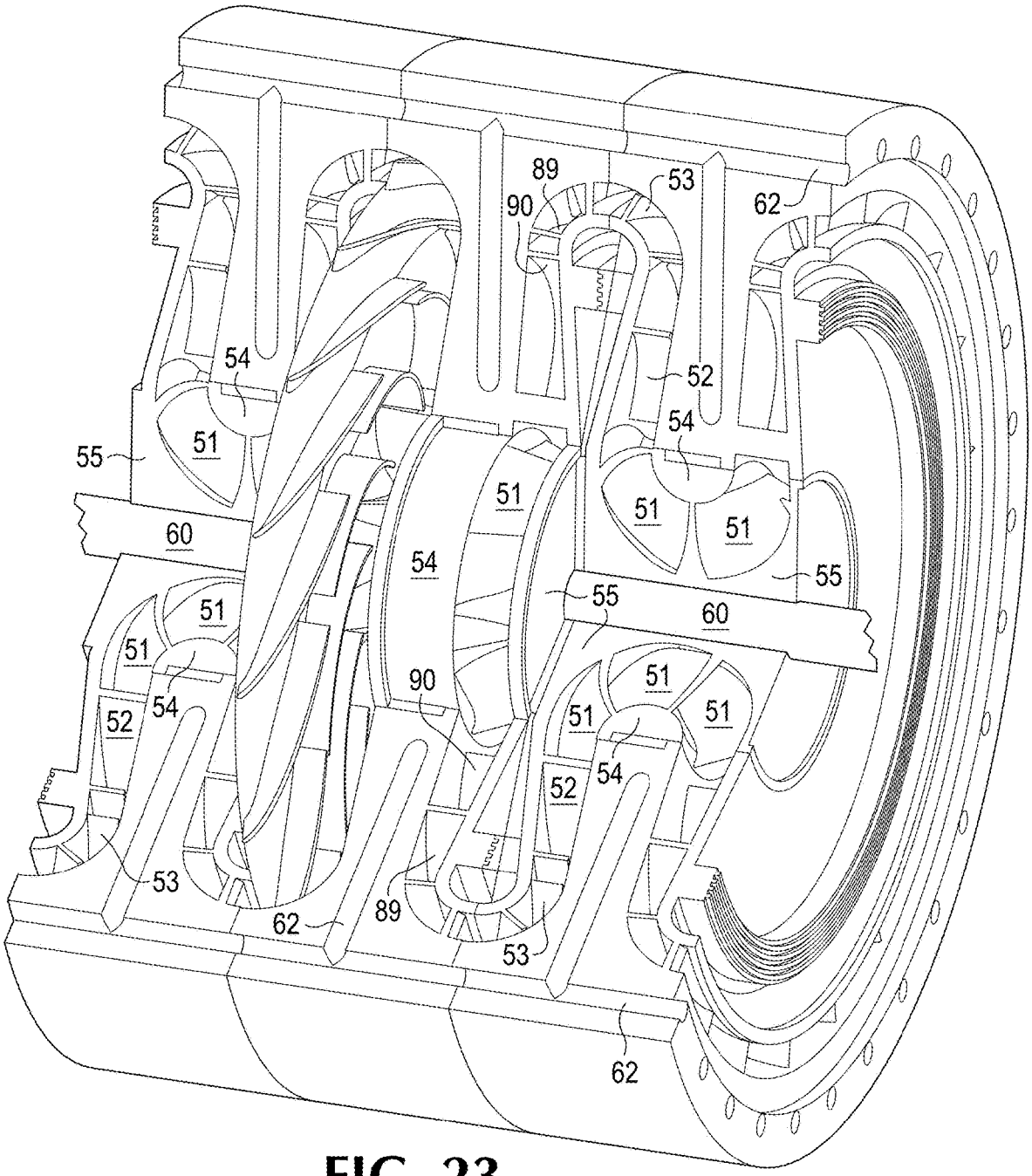
FIG. 23 is a one-third section view of three stages of the multistage, multi-blade-row pump of FIG. 18.
Figure 24:
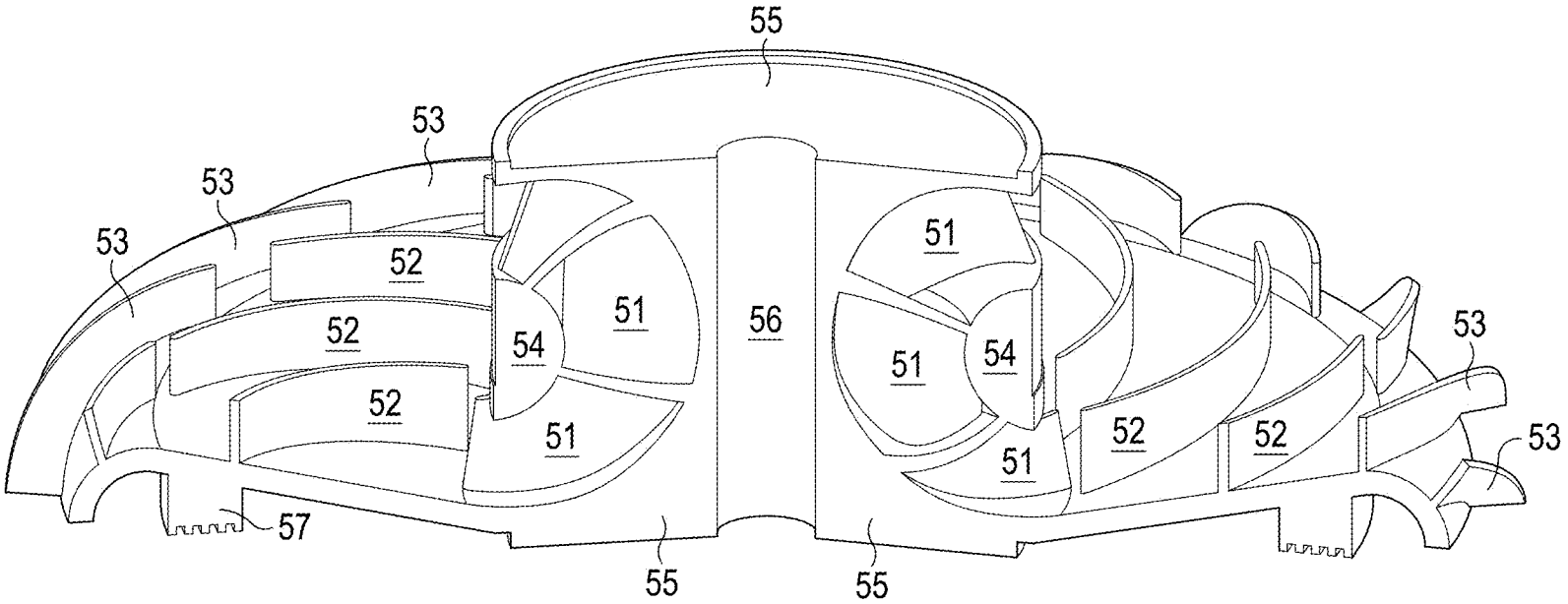
FIG. 24 is a section view of one impeller stage of the multistage, multi-blade-row pump of FIG. 18.
Figure 25:
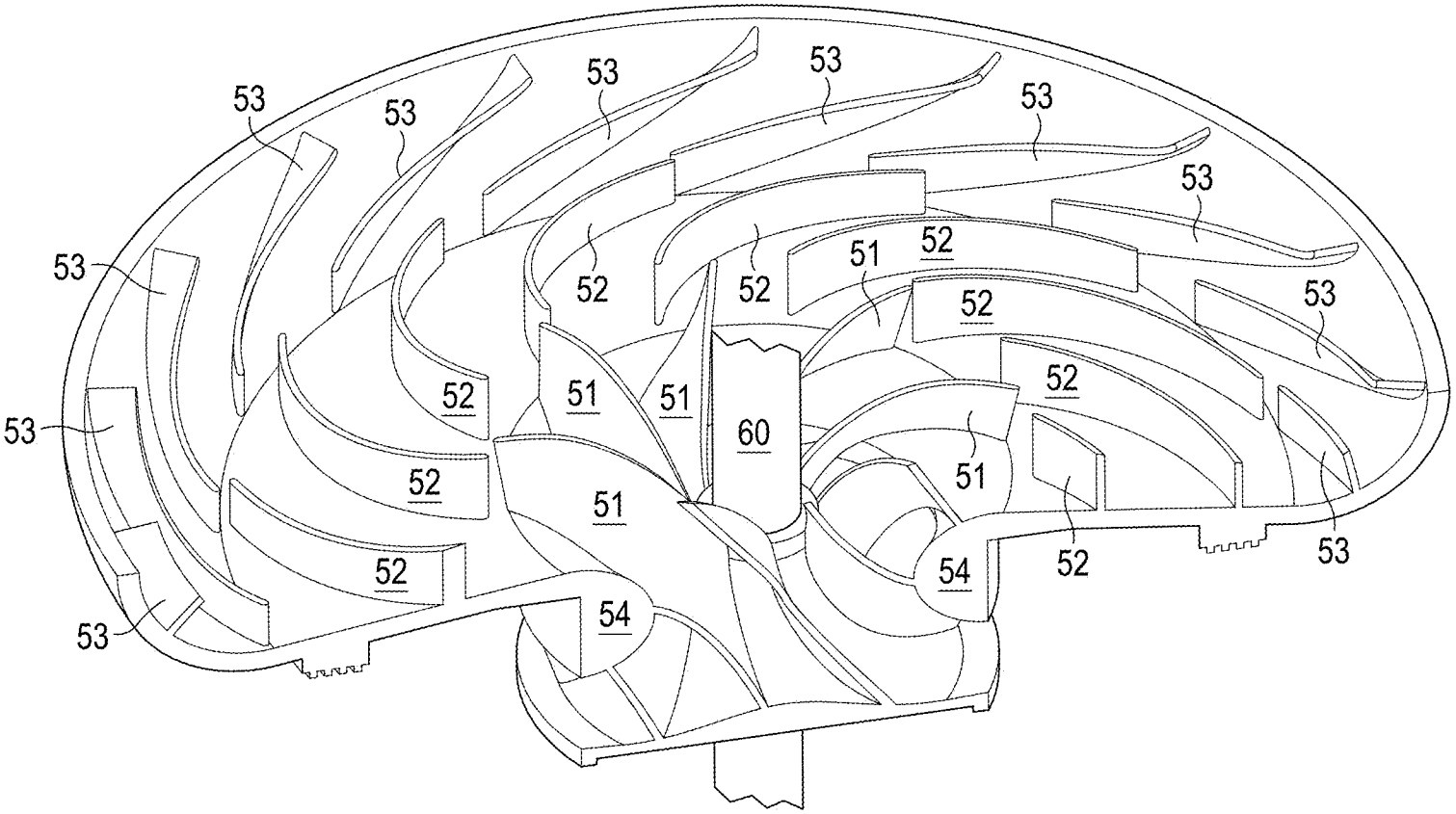
FIG. 25 is another section view of one impeller stage of the multistage, multi-blade-row pump of FIG. 18.
Figure 26:
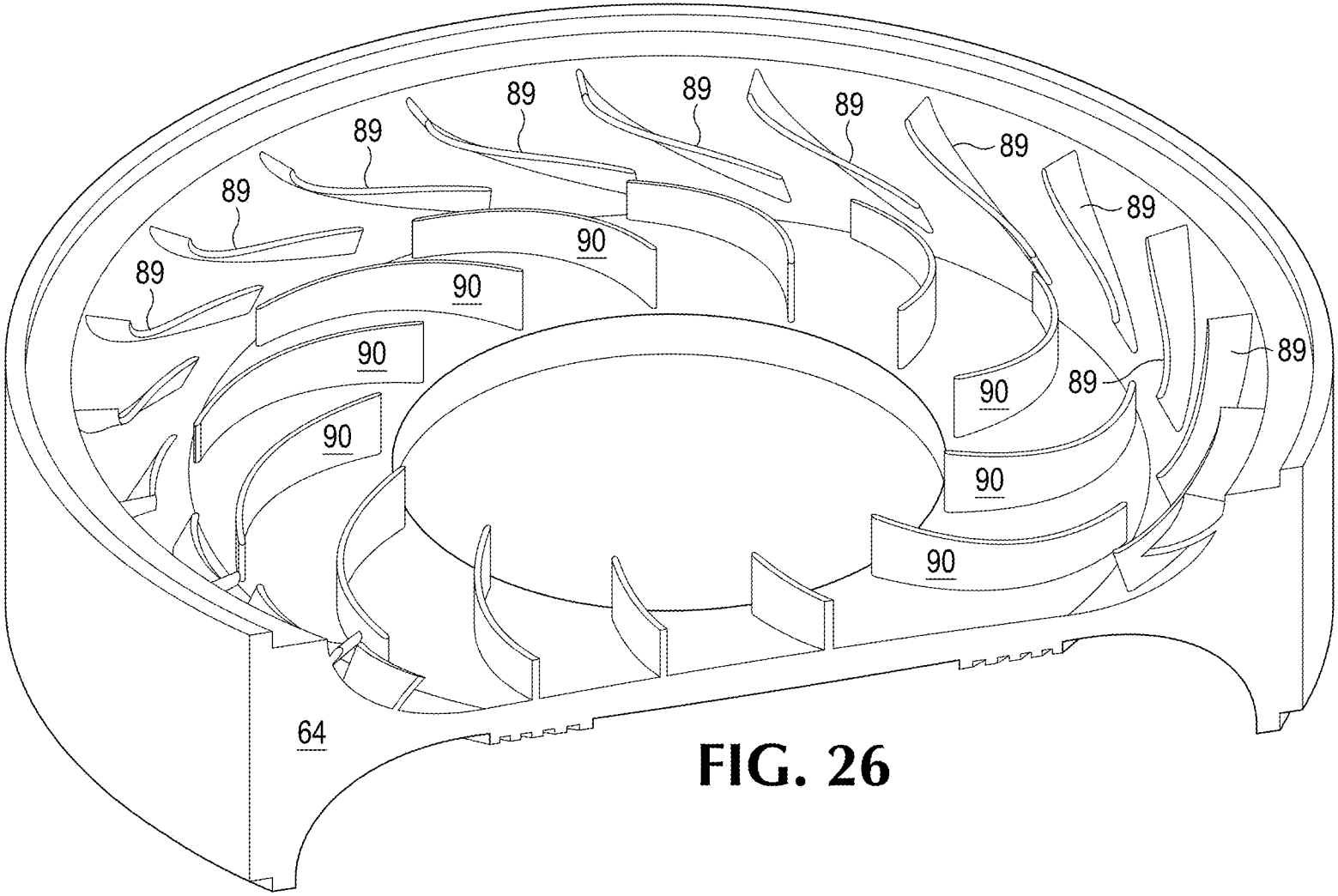
FIG. 26 is a section view of one diffuser stage of the multistage, multi-blade-row pump of FIG. 18.

FIG. 18 is a perspective view illustrating portions of a multistage, multi-blade-row pump, illustrating an example of an open-blade-row impeller according to an example configuration. FIG. 19 is a quarter section view of the multistage, multi-blade-row pump of FIG. 18. FIG. 20 is a section view of the multistage, multi-blade-row pump of FIG. 18. FIG. 21 is a section view of three stages of the multistage, multi-blade-row pump of FIG. 18. FIG. 22 is a partial section view of a portion of the multistage, multi-blade-row pump of FIG. 18. FIG. 23 is a one-third section view of three stages of the multistage, multi-blade-row pump of FIG. 18. FIG. 24 is a section view of one impeller stage of the multistage, multi-blade-row pump of FIG. 18. FIG. 25 is another section view of one impeller stage of the multistage, multi-blade-row pump of FIG. 18. FIG. 26 is a section view of one diffuser stage of the multistage, multi-blade-row pump of FIG. 18.

As illustrated in FIGS. 18-26, multistage, multi-blade-row pump 400 is substantially the same as the multistage, triple-blade-row pump 300 described above for FIGS. 8-11. Accordingly, features not described here are as described above for the multistage, triple-blade-row pump 300 of FIGS. 8-11. The configuration illustrated in FIGS. 18-26 primarily differs from the configuration illustrated in FIGS. 8-11 in that a first row 51 of impeller blades is closed and may be integral with situated between impeller band 54 and impeller hub 55. In other words, first row 51 of impeller blades is "closed" because the flow through the first row 51 of impeller blades is bounded in part by another portion of the impeller stage 65. As illustrated, the second row 52 of impeller blades and the third row 53 of impeller blades are open, meaning that the flow through the second row 52 of impeller blades and the third row 53 of impeller blades is bounded in part by the non-rotating diffuser stage 64. Stated another way, the flow through the second row 52 of impeller blades and the third row 53 of impeller blades is through a flow channel 156 that is bounded on a first axial side by a surface 157 of the impeller stage 65 and on a second axial side by a surface of the diffuser stage 64, namely the runner crown 58.

As illustrated in FIGS. 18-26, a centrifugal impeller stage 65 is configured to rotate about an axis of rotation 86 that is collinear with a shaft tie rod 60 (which is further explained below). The impeller stage 65 has three, separate rows of impeller blades. The first row 51 of impeller blades is configured to accept a fluid flow in the inward radial direction 153, such as from an inlet manifold 34, 35 or a preceding pump stage's diffuser stage 64. The first row 51 of impeller blades is configured accelerate the flow on a vector first away from and then toward the axis of rotation 86, and discharge the fluid flow in the outward radial direction 152 to a second row 52 of impeller blades. The second row 52 of impeller blades is configured to accelerate the flow in the outward radial direction 152. A third row 53 of impeller blades is configured to accept the flow in the outward radial direction 152 from the second row 52 of impeller blades, first accelerate the flow on a vector toward the axis of rotation 86 in the inward radial direction 153, and then accelerate the fluid flow in the forward axial direction 150 to discharge the flow axially to the subsequent diffuser stage 64.

Multiple impeller hubs 55 may be stacked end-on-end to form a (segmented) shaft with both bending and torsional rigidity and strength. The stacked impeller hubs 55 may be held together with shaft tie rod 60 running through a hole 56 in the impeller hub 55. Housing sections 37, 38, 39, 40, 41, and 42 are held together with housing tie rods 88. A runner crown 58 encloses the rows 51, 52, and 53. A labyrinth seal 57 provides sealing between stages. Face keys or dowels, for example, may be used to transmit torque from one impeller hub 55 to the next impeller hub 55. The diffuser stages 64 may incorporate cooling channels 62, which may serve as a heat pipe or may be used for liquid cooling, for example.

Each diffuser stage 64 is about the axis of rotation 86 but does not rotate about the axis of rotation 86. In the illustrated configuration, the diffuser stage 64 has two rows of diffuser blades. The first row 89 of diffuser blades is configured to receive the flow from the previous impeller stage 65, first accelerate the flow in the forward axial direction 150, and then accelerate the flow on a vector toward the axis of rotation 86. The second row 90 of diffuser blades is configured to accelerate the flow in the inward radial direction 153. Hence, the second row 90 of diffuser blades is nominally radial. In configurations having multiple stages, the second row 90 of diffuser blades discharge the fluid flow from the diffuser stage 64 into the next impeller stage 65.

Assembly may be carried out by stacking impeller stages 65 between diffuser stages 64, securing the impeller stages 65 together with the tie rod 60 (which may be enlarged to incorporate a heat pipe), and bolting together diffuser stages 64 with tie rods 88. Inlet manifolds 34, 35 may be used at one or both ends of the assembly 400. One or more discharge manifolds 36 may also be used within the assembly 400.

Figure 27:
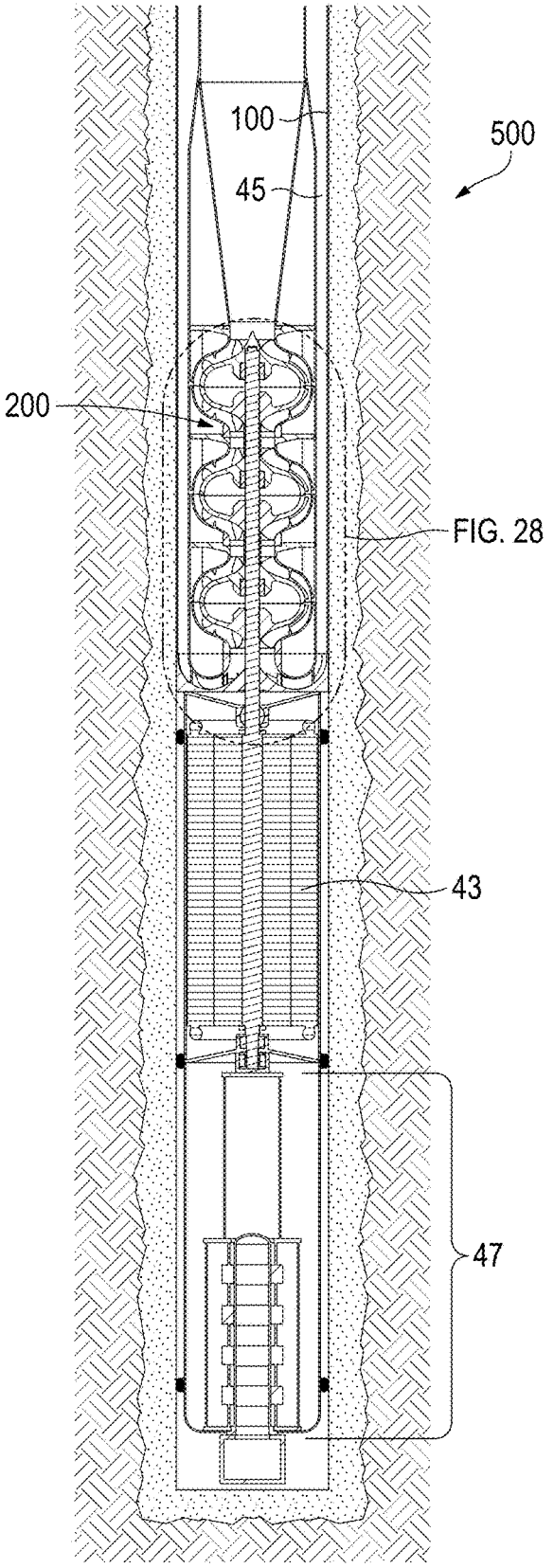
FIG. 27 illustrates an example of a multistage, multi-blade-row, reversible pump-turbine assembly installed in a vertical well.
Figure 28:
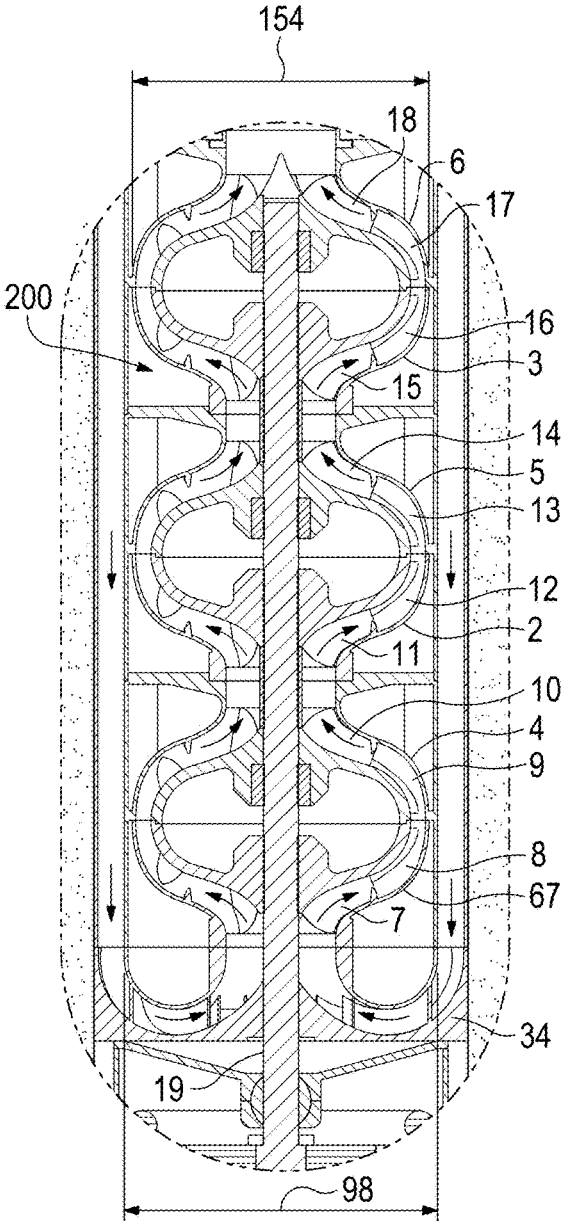
FIG. 28 is a detail version of a portion of the assembly of FIG. 27.

FIG. 27 illustrates portions of an example of a multistage, multi-blade-row, reversible pump-turbine assembly installed in a vertical well. FIG. 28 is a detail version of a portion of the assembly of FIG. 27. As illustrated in FIGS. 27 and 28, the multistage, multi-blade-row, reversible pump-turbine assembly 500 of FIGS. 27 and 28 may include the multistage, tandem-blade-row pump 200 of FIGS. 3 and 4. Accordingly, the components identified in FIGS. 27 and 28 are as described above for the components having the same reference numbers in FIGS. 3 and 4. Although depicted as having three stages, as noted above, the multistage, tandem-blade-row pump 200 may have fewer than three stages or more stages than three in some configurations.

Additionally, the multistage, multi-blade-row, reversible pump-turbine assembly 500 of FIGS. 27 and 28 may include a submersible motor-generator 43 and its associated submersible electrical connector 47. As noted, the well 100 is vertical; so given the direction of gravity, "up" is toward the top of FIG. 27 and "down" is toward the bottom of FIG. 27. As a result, the electrical connector 47 is shown at the bottom of the well 100, beneath the submersible motor-generator 43. And the submersible motor-generator 43 is beneath the multistage, tandem-blade-row pump 200.

In pumping mode of the reversible pump-turbine assembly 500, the flow descends the well 100 through an annular flow passageway 45. The annular flow passageway 45 discharges (in pumping mode) into inlet manifold 34. The flow in pumping mode then enters axially into the first pump stage 67, and the flow proceeds within the multistage, tandem-blade-row pump 200 as described above for FIGS. 3 and 4.

Figure 32:
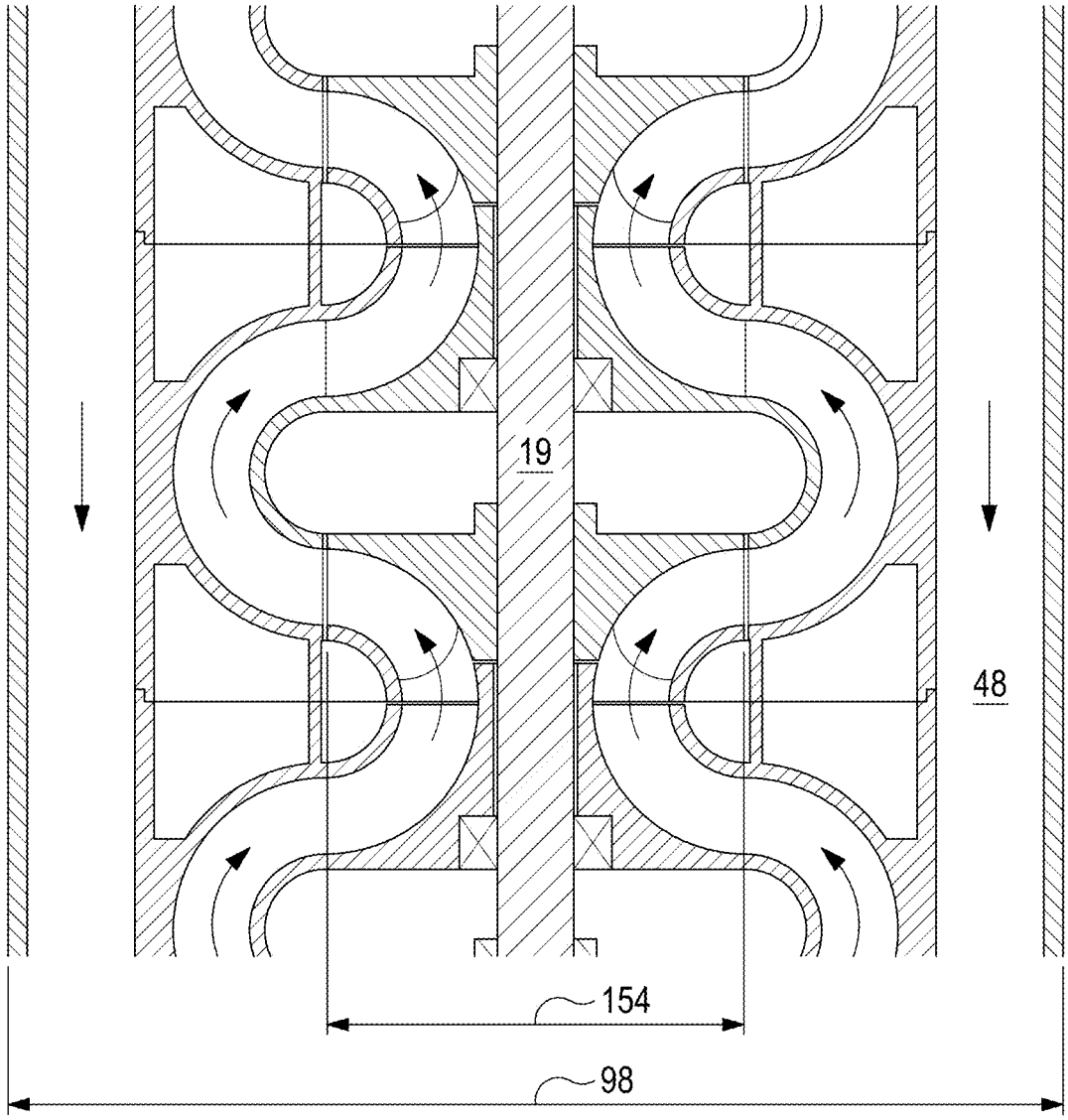
FIG. 32 Prior Art
FIG. 32 illustrates an example of a prior-art configuration having an annular water passageway.

It should be noted that the illustrated configuration results, for a given impeller diameter 154 in a smaller overall machine diameter 98 than is achieved with the prior art multistage pump turbine of FIG. 32, where the impeller discharges its flow radially. The head developed per stage at any given shaft speed is generally proportional to impeller diameter squared. Minimizing machine diameter 98 not only reduces machine size, weight, and cost, but also reduces the required diameter and cost of the well required for installation. It should be noted that the construction of a well entails significantly less geological risk and construction cost than does construction of an underground powerhouse.

Figure 29:
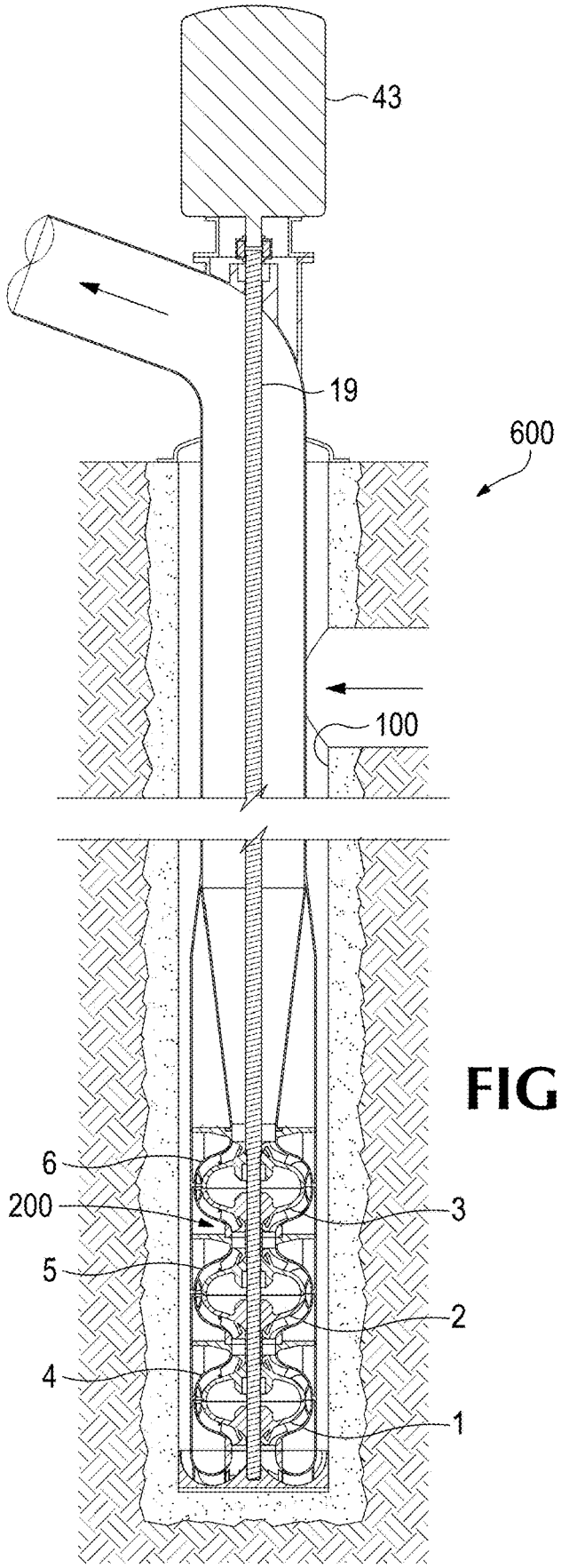
FIG. 29 illustrates another example of a multistage, multi-blade-row, reversible pump-turbine assembly installed in a vertical well.

FIG. 29 illustrates another example of a multistage, multi-blade-row, reversible pump-turbine assembly installed in a vertical well. The multistage, multi-blade-row, reversible pump-turbine assembly 600 of FIG. 29 is hydraulically similar to the multistage, multi-blade- row, reversible pump-turbine assembly 500 of FIGS. 27 and 28, except that the motor-generator 43 is above the multistage, tandem-blade-row pump 200. As a result, the motor-generator 43 of FIG. 29 may be, for example, an air-cooled, above-ground motor-generator. As with FIG. 27, given the direction of gravity, "up" is toward the top of FIG. 29 and "down" is toward the bottom of FIG. 29.

Figure 30:
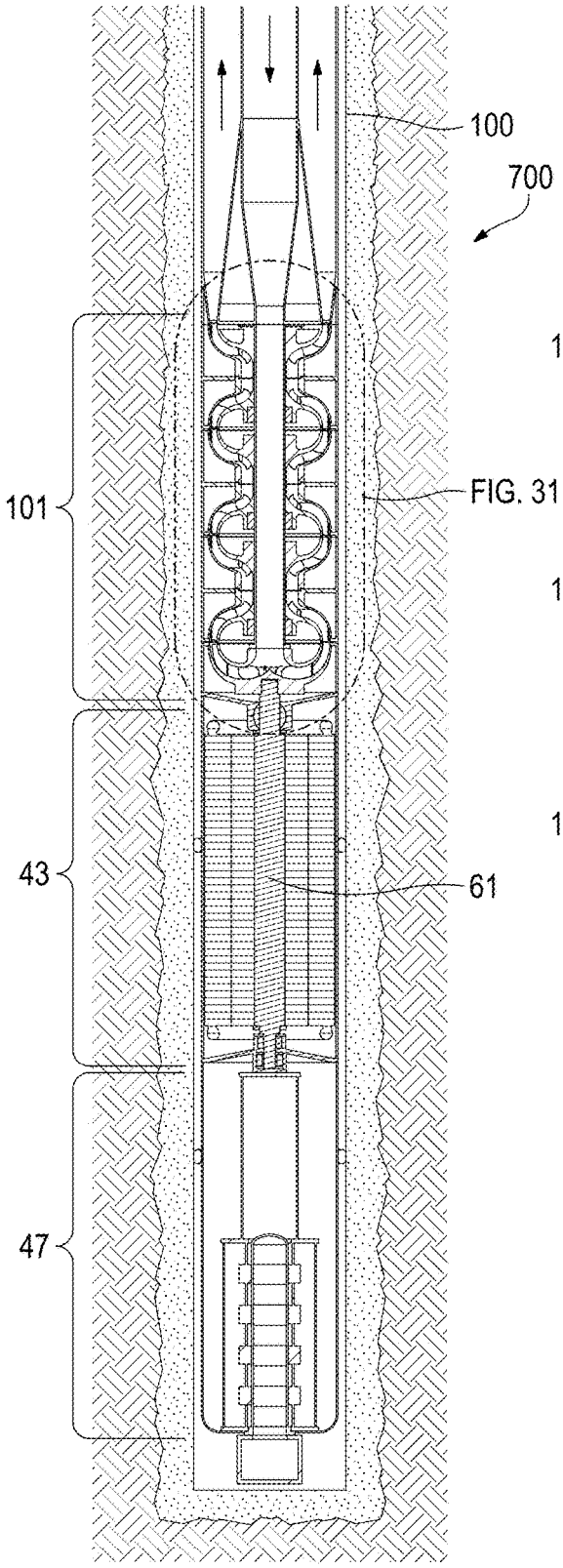
FIG. 30 illustrates still another example of a multistage, multi-blade-row, reversible pump-turbine assembly installed in a vertical well.
Figure 31:
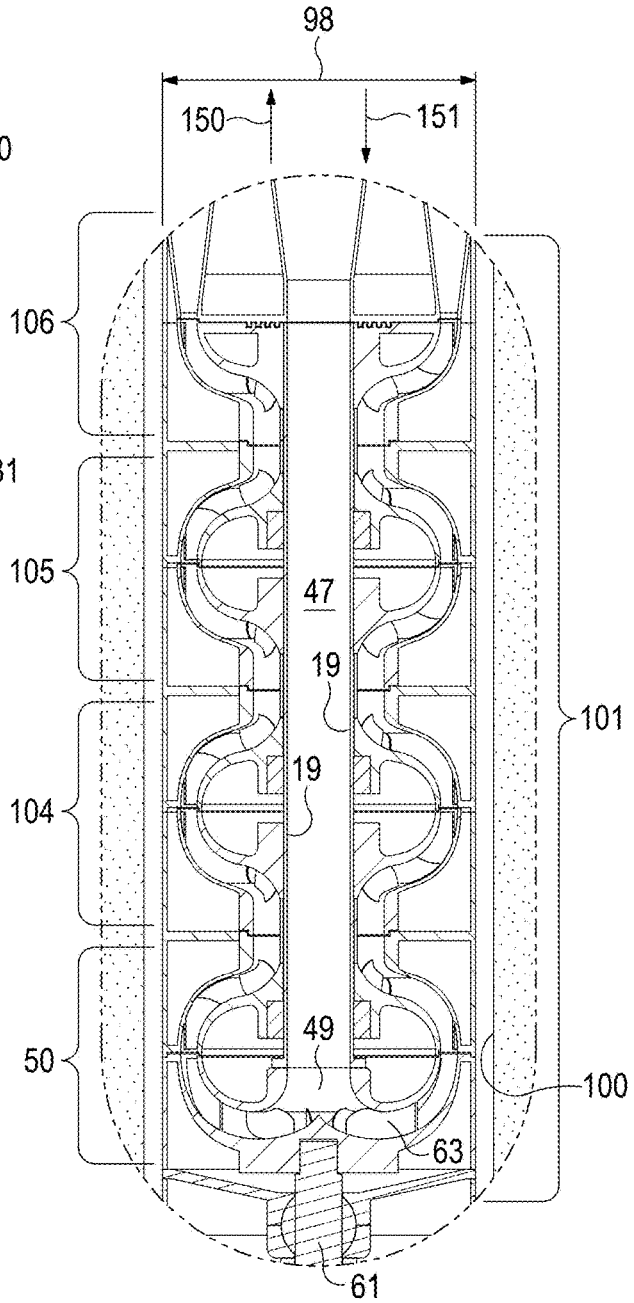
FIG. 31 is a detail version of a portion of the assembly of FIG. 30.

FIG. 30 illustrates still another example of a reversible pump-turbine assembly 700 installed in a vertical well 100. FIG. 31 is a detail version of a portion of the reversible pump-turbine assembly 700 of FIG. 30. As with FIG. 27, given the direction of gravity, "up" is toward the top of FIG. 30 and "down" is toward the bottom of FIG. 30.

As illustrated, the outside diameter of a multistage pump-turbine 101 has been reduced by utilizing a water passageway 47 within the power transmitting shaft 19 for water conveyance to the pump inlet 49. Allocating the center of the shaft 19 to water conveyance has minimal effect of torque capacity of the shaft 19. This arrangement eliminates the need for an annular water passageway 48 shown in FIG. 32. This results in a pump-turbine of smaller overall machine diameter 98 and, in turn, a well 100 of relatively lesser diameter and lower cost. As illustrated, the first pump stage 50 is similar to the pump configuration disclosed in U.S. Pat. No. 11,300,093. Accordingly, the first pump stage 50 includes a first impeller stage that is configured to rotate about an axis of rotation (collinear with hollow shaft 120), accept a fluid flow from a second axial direction 151, redirect the fluid flow through a toroidal fluid flow path, and discharge the fluid flow in a first axial direction 150 that is opposite to the second axial direction 151 into a first diffuser stage of the first pump stage 50. Note that the torque between the motor shaft 61 and the pump shaft 19 is carried through the pump blades 63.

The second pump stage 104, third pump stage 105, and fourth pump stage 106 may utilize mixed-flow impellers of either conventional design or in accordance with the tandem-blade-row technology discussed in this patent application with regard to FIGS. 3 and 4. Accordingly, the second pump stage 104, the third pump stage 105, and the fourth pump stage 106 may have the features described above for the first pump stage 67, the second pump stage 68, and the third pump stage 69 of FIGS. 3 and 4.

Connection to the pump may be accomplished by using the "flow inverter" disclosed in U.S. Pat. No. 11,300,093 to not require that the well 100 withstand the pump outlet pressure and to not subject the low pressure pipe connection to external buckling pressure. U.S. Pat. No. 11,300,093 is hereby incorporated by reference.

FIG. 32 illustrates an example of a prior-art configuration having an annular water passageway, which is used as a point of comparison to some of the features discussed above.

Figure 33:
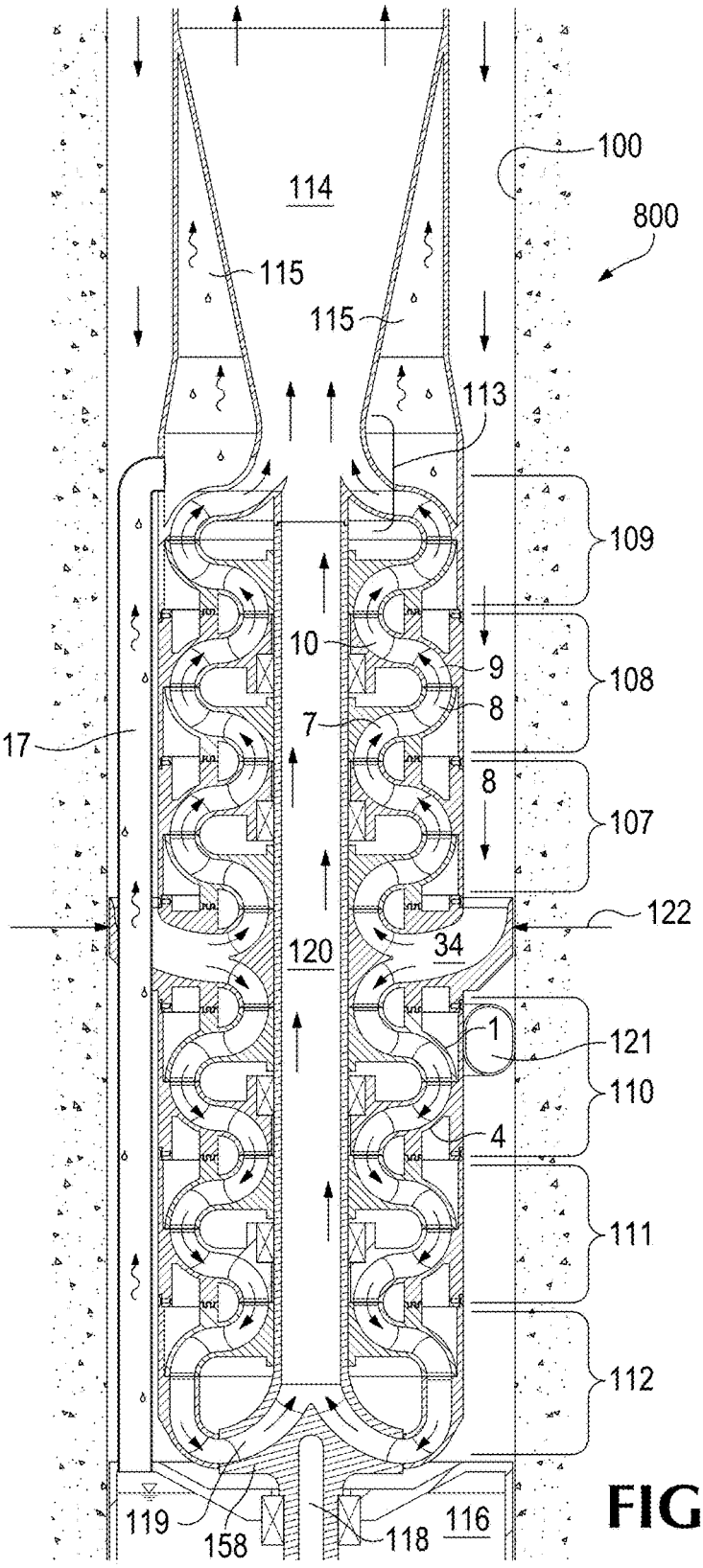
FIG. 33 illustrates a cross section of an example of a multistage pump-turbine installed in a vertical well.
Figure 34:
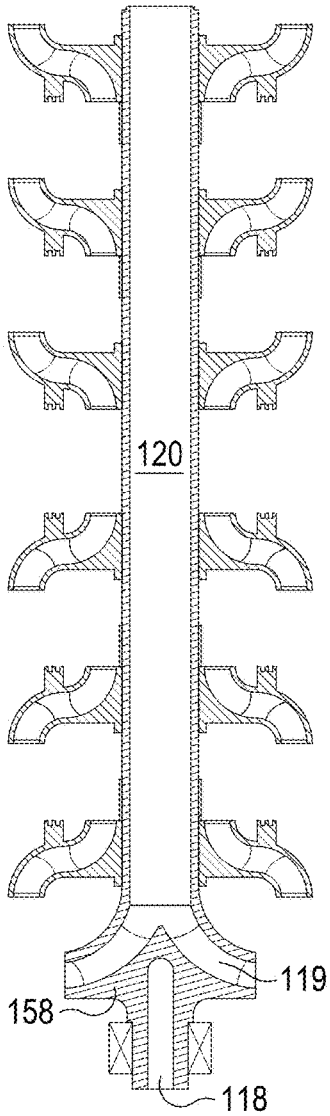
FIG. 34 illustrates a portion of the multistage pump-turbine of FIG. 33 in isolation.

FIG. 33 illustrates a cross section of portions of an example of a multistage, reversible pump-turbine 800 installed in a vertical well. FIG. 34 illustrates a portion of the multistage pump-turbine of FIG. 33, namely the rotating assembly of FIG. 33, in isolation. The multistage, reversible pump-turbine 800 of FIG. 33 may be substituted for, as examples, the multistage, tandem-blade-row pump 200 of FIGS. 27 or 29 or the multistage pump-turbine 101 of FIG. 30.

As illustrated in FIG. 33, a submersible, multistage, reversible pump-turbine 800 is shown in a vertical well 100. An inlet manifold 34 accepts flow from above. The inlet manifold 34 divides the flow between three upper pump stages 107, 108, and 109 and three lower pump stages 110, 111, and 112. As noted, the well 100 is vertical; so given the direction of gravity, "up" and "upward" is toward the top of FIG. 33 and "down" and "downward" is toward the bottom of FIG. 33. As a result, the pump stage 112 is below the inlet manifold 34, while the pump stage 109 is above the inlet manifold 34. The flow is recombined by an outlet manifold 113 and discharged into a diffuser 114. The diffuser 114 is surrounded by heat pipe condenser 115, which is connected to motor-generator housing 116 by at least one heat pipe 117.

A shaft coupling 158 is hydraulically configured with streamlined torque transmitting blades 119, which allow high-pressure fluid from the pump stage 112 to enter a hollow shaft 120. The hollow shaft 120 may feature a continuous external spline for the purpose of driving the impellers associated with pump stages 107, 108, 109, 110, 111, and 112. The impellers may be axially spaced by internally splined journals similar to bushings 66 of FIGS. 16 and 17.

The shaft coupling 158 may also incorporate a heat pipe condenser 118 for cooling the rotor of the motor generator (see the motor-generator 43 of FIGS. 27 or 30). Note that the heat pipe condenser 118 may be extended for some distance into the hollow shaft 120 to more effectively cool the motor-generator rotor. The shaft coupling 158 may be coupled to, or integrated with, the motor shaft of the motor-generator, such as the motor shaft 61 illustrated in FIGS. 30 and 31.

An inflatable seal 121 may be provided to mechanically center the assembly within the well 100. The inflatable seal 121 may also serve to keep sediment from entering and accumulating in the annular clearance space between the well 100 and the motor generator. In configurations having the inflatable seal 121, the heat pipes 117 penetrate through gaps between segments of the inflatable seal 121.

In configurations, one or more stages of the multistage, reversible pump-turbine 800 of FIG. 33 may include the tandem-blade-row technology discussed in this patent application with regard to FIGS. 3 and 4. Accordingly, the forward axial direction 150 for the lower pump stages 110, 111, and 112 would be downward, while the forward axial direction 150 for the upper pump stages 107, 108, and 109 would be upward.

The illustrated configuration provides high head on account of multiple stages, each with large impeller discharge diameters (relative to the machine outer diameter 122) within a well 100 of limited diameter. Thrust is substantially balanced due to the equal numbers of axially opposed pump stages. The high-pressure discharge from diffuser 114 is conveniently in the middle of the well where it may be conveyed upward with relatively thin-walled penstock, not subject to collapse as it would be if the external pressure was higher than the internal pressure. A "flow inverter" is thus not needed for this configuration of the disclosed technology.

In general, this disclosed technology teaches the benefit of using vanes and blades, not only to extract and impart momentum to a gas or fluid, but to simultaneously serve as "cornering vanes" to accomplish changes in direction within the meridional plane. Changes in direction in the meridional plane are inherently orthogonal to changes in angular momentum. It is an object of this invention to provide blade surfaces that impart the vector sum of both of these required momentum changes to the fluid or gas to which energy is being imparted or from which energy is being extracted. Hopefully this technological development will set a new standard in efficiently managing the meridional flow path of fluids and gases through turbomachinery. The opportunities for both energy conservation and capital equipment cost reduction are significant.

As can be easily understood from the foregoing, the basic concepts of the present invention may be embodied in a variety of ways. It may involve hydromotive machines, such pumps, pump-turbines, turbines, blowers, compressors, turbochargers, superchargers, or gas turbines, or other devices to accomplish the appropriate method. In this application, the fluid machinery methods are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

EXAMPLES

Illustrative examples of the disclosed technologies are provided below. A particular configuration of the technologies may include one or more, and any combination of, the examples described below.

Example 1 includes a machine comprising: a centrifugal impeller stage configured to rotate about an axis of rotation, the impeller stage having two, separate rows of impeller blades, a first row of impeller blades configured to accept a fluid flow in a first axial direction, accelerate the fluid flow on a vector away from the axis of rotation, and discharge the fluid flow in an outward radial direction to a second row of impeller blades, and the second row of impeller blades configured to accept the fluid flow in the outward radial direction from the first row of impeller blades, first accelerate the fluid flow on a vector toward the axis of rotation in an inward radial direction, and then accelerate the fluid flow in the first axial direction; and a diffuser stage about the axis of rotation, the diffuser stage having two rows of diffuser blades, a first row of diffuser blades configured to receive the fluid flow from the impeller stage, first accelerate the fluid flow in the first axial direction, and then accelerate the fluid flow on a vector toward the axis of rotation, and a second row of diffuser blades configured to accept the fluid flow in the inward radial direction from the first row of diffuser blades, first accelerate the fluid flow on a vector away from the axis of rotation, then accelerate the fluid flow in the first axial direction, and then discharge the fluid flow from the diffuser stage in the first axial direction.

Example 2 includes the machine of Example 1, in which the impeller stage is a first impeller stage, and in which the second row of diffuser blades is configured to discharge the fluid flow from the diffuser stage in the first axial direction into a second impeller stage, in which the second impeller stage is configured to rotate about the axis of rotation, the second impeller stage having two rows of impeller blades, a first row of impeller blades of the second impeller stage configured to accept the fluid flow from the diffuser stage, accelerate the fluid flow on a vector away from the axis of rotation, and discharge the fluid flow in the outward radial direction to a second row of impeller blades of the second impeller stage, and the second row of impeller blades of the second impeller stage configured to accept the fluid flow in the outward radial direction from the first row of impeller blades of the second impeller stage, first accelerate the fluid flow on a vector toward the axis of rotation in the inward radial direction, and then accelerate the fluid flow in the first axial direction.

Example 3 includes the machine of Example 2, in which the diffuser stage is a first diffuser stage, the machine further comprising a second diffuser stage about the axis of rotation, the second diffuser stage having two rows of diffuser blades, a first row of diffuser blades of the second diffuser stage configured to receive the fluid flow from the second impeller stage, first accelerate the fluid flow in the first axial direction, and then accelerate the fluid flow in on a vector toward the axis of rotation, and a second row of diffuser blades of the second diffuser stage configured to accept the fluid flow in the inward radial direction from the first row of diffuser blades of the second diffuser stage, first accelerate the fluid flow on a vector away from the axis of rotation, then accelerate the fluid flow in the first axial direction, and then discharge the fluid flow from the second diffuser stage in the first axial direction.

Example 4 includes the machine of any of Examples 1-3, in which each of the impeller stage and the diffuser stage has an outer diameter, in which the outer diameter of the impeller stage is not larger than the outer diameter of the diffuser stage.

Example 5 includes the machine of Example 4, in which the outer diameter of the impeller stage is substantially equal to the outer diameter of the diffuser stage.

Example 6 includes a centrifugal impeller for a machine, the impeller comprising: a first row of impeller blades shaped and positioned to accept a fluid flow in a first axial direction, accelerate the fluid flow away from an axis of rotation of the impeller, and discharge the fluid flow in an outward radial direction to a second row of impeller blades; and the second row of impeller blades shaped and positioned to accept the fluid flow in the outward radial direction from the first row of impeller blades, first accelerate the fluid flow on a vector toward the axis of rotation in an inward radial direction, and then accelerate the fluid flow in the first axial direction.

Example 7 includes a diffuser for a machine, the diffuser comprising: a first row of diffuser blades shaped and positioned to receive a fluid flow in a first axial direction, accelerate the fluid flow in the first axial direction, and then accelerate the fluid flow on a vector toward the axis of rotation; and the second row of diffuser blades shaped and positioned to accept the fluid flow in an inward radial direction from the first row of diffuser blades, first accelerate the fluid flow on a vector away from the axis of rotation, then accelerate the fluid flow in the first axial direction, and then discharge the fluid flow from the diffuser stage in the first axial direction.

Example 8 includes a machine comprising: a centrifugal impeller stage configured to rotate about an axis of rotation, the impeller stage having three, separate rows of impeller blades, a first row of impeller blades configured to accept a fluid flow in a first axial direction, accelerate the fluid flow on a vector away from the axis of rotation, and discharge the fluid flow in an outward radial direction to a second row of impeller blades, the second row of impeller blades configured to accelerate the fluid flow in the outward radial direction by a radial velocity component and also to accelerate the fluid flow in a second axial direction by an axial velocity component, the second axial direction being opposite to the first axial direction, and a third row of impeller blades configured to accept the fluid flow in the outward radial direction from the second row of impeller blades, first accelerate the fluid flow on a vector toward the axis of rotation in an inward radial direction, and then accelerate the fluid flow in the first axial direction; and a diffuser stage about the axis of rotation, the diffuser stage having three rows of diffuser blades, a first row of diffuser blades configured to receive the fluid flow from the impeller stage, first accelerate the fluid flow in the first axial direction, and then accelerate the fluid flow on a vector toward the axis of rotation, a second row of diffuser blades configured to accelerate the fluid flow in the inward radial direction by the radial velocity component and also to accelerate the fluid flow in the second axial direction by the axial velocity component, and a third row of diffuser blades configured to accept the fluid flow in the inward radial direction from the second row of diffuser blades, first accelerate the fluid flow on a vector away from the axis of rotation, then accelerate the fluid flow in the first axial direction, and then discharge the fluid flow from the diffuser stage in the first axial direction.

Example 9 includes the machine of Example 8, in which each of the impeller stage and the diffuser stage has an outer diameter, in which the outer diameter of the impeller stage is not larger than the outer diameter of the diffuser stage.

Example 10 includes the machine of Example 9, in which the outer diameter of the impeller stage is substantially equal to the outer diameter of the diffuser stage.

Example 11 includes the machine of any of Examples 8-10, in which the impeller stage is a first impeller stage, and in which the second row of diffuser blades is configured to discharge the fluid flow from the diffuser stage in the first axial direction into a second impeller stage configured to rotate about the axis of rotation, in which the second impeller stage comprises: a first row of impeller blades of the second impeller stage configured to accept the fluid flow in the first axial direction, accelerate the fluid flow on a vector away from the axis of rotation, and discharge the fluid flow in an outward radial direction to a second row of impeller blades of the second impeller stage; the second row of impeller blades of the second impeller stage configured to accelerate the fluid flow in the outward radial direction by a radial velocity component of the second impeller stage and also to accelerate the fluid flow in the second axial direction by an axial velocity component of the second impeller stage,; and a third row of impeller blades of the second impeller stage configured to accept the fluid flow in the outward radial direction from the second row of impeller blades of the second impeller stage, first accelerate the fluid flow on a vector toward the axis of rotation in the inward radial direction, and then accelerate the fluid flow in the first axial direction.

Example 12 includes the machine of Example 11, in which the diffuser stage is a first diffuser stage, the machine further comprising a second diffuser stage about the axis of rotation, the second diffuser stage comprising: a first row of diffuser blades of the second diffuser stage configured to receive the fluid flow from the second impeller stage, first accelerate the fluid flow in the first axial direction, and then accelerate the fluid flow on a vector toward the axis of rotation; and a second row of diffuser blades of the second diffuser stage configured to accelerate the fluid flow in the inward radial direction by the radial velocity component and also to accelerate the fluid flow in the second axial direction by the axial velocity component, and a third row of diffuser blades of the second diffuser stage configured to accept the fluid flow in the inward radial direction from the second row of diffuser blades of the second diffuser stage, first accelerate the fluid flow on a vector away from the axis of rotation, then accelerate the fluid flow in the first axial direction, and then discharge the fluid flow from the diffuser stage in the first axial direction.

Example 13 includes a centrifugal impeller for a machine, the impeller comprising: a first row of impeller blades configured to accept a fluid flow in a first axial direction, accelerate the fluid flow on a vector away from the axis of rotation of the impeller, and discharge the fluid flow in an outward radial direction to a second row of impeller blades; the second row of impeller blades configured to accelerate the fluid flow in the outward radial direction by a radial velocity component and also to accelerate the fluid flow in a second axial direction by an axial velocity component, the second axial direction being opposite to the first axial direction; and a third row of impeller blades configured to accept the fluid flow in the outward radial direction from the second row of impeller blades, first accelerate the fluid flow on a vector toward the axis of rotation in an inward radial direction, and then accelerate the fluid flow in the first axial direction.

Example 14 includes a diffuser for a machine, the diffuser comprising: a first row of diffuser blades configured to receive the fluid flow from the impeller stage, first accelerate the fluid flow in a first axial direction, and then accelerate the fluid flow on a vector toward an axis of rotation of the diffuser; a second row of diffuser blades configured to accelerate the fluid flow in an inward radial direction by a radial velocity component and also to accelerate the fluid flow in a second axial direction by an axial velocity component, the second axial direction being opposite to the first axial direction; and a third row of diffuser blades configured to accept the fluid flow in the inward radial direction from the second row of diffuser blades, first accelerate the fluid flow on a vector away from the axis of rotation, then accelerate the fluid flow in the first axial direction, and then discharge the fluid flow from the diffuser stage in the first axial direction.

Example 15 includes a machine comprising: a centrifugal impeller stage configured to rotate about an axis of rotation, the impeller stage having three, separate rows of impeller blades, a first row of impeller blades is configured to accept a fluid flow in an inward radial direction, accelerate the fluid flow first away from and then toward the axis of rotation, and discharge the fluid flow in an outward radial direction to a second row of impeller blades, the second row of impeller blades is configured to accelerate the fluid flow in the outward radial direction, and a third row of impeller blades is configured to accept the fluid flow in the outward radial direction from the second row of impeller blades, first accelerate the fluid flow on toward the axis of rotation in the inward radial direction, and then accelerate the fluid flow in a forward axial direction to discharge the fluid flow axially; and a diffuser stage about the axis of rotation, the diffuser stage having two rows of diffuser blades, a first row of diffuser blades is configured to receive the fluid flow from a previous impeller stage, first accelerate the fluid flow in the forward axial direction, and then accelerate the fluid flow toward the axis of rotation, and a second row of diffuser blades is configured to accelerate the fluid flow in the inward radial direction and to discharge the fluid flow from the diffuser stage into a subsequent impeller stage, in which the fluid flow through the second row of impeller blades and the third row of impeller blades is through a fluid flow channel that is bounded on a first axial side by a surface of the impeller stage and on a second axial side by a surface of the diffuser stage.

Example 16 includes a reversible pump-turbine suitable for installation into a vertical well, the reversible pump-turbine comprising: a multi-stage impeller-diffuser having: a first impeller stage configured to rotate about an axis of rotation, the first impeller stage having two, separate rows of impeller blades, a first row of impeller blades configured to accept a fluid flow in a first axial direction, accelerate the fluid flow on a vector away from the axis of rotation, and discharge the fluid flow in an outward radial direction to a second row of impeller blades, and the second row of impeller blades configured to accept the fluid flow in the outward radial direction from the first row of impeller blades, first accelerate the fluid flow on a vector toward the axis of rotation in an inward radial direction, and then accelerate the fluid flow in the first axial direction, a first diffuser stage about the axis of rotation, the first diffuser stage having two rows of diffuser blades, a first row of diffuser blades configured to receive the fluid flow from the impeller stage, first accelerate the fluid flow in the first axial direction, and then accelerate the fluid flow on a vector toward the axis of rotation, and a second row of diffuser blades configured to accept the fluid flow in the inward radial direction from the first row of diffuser blades, first accelerate the fluid flow on a vector away from the axis of rotation, then accelerate the fluid flow in the first axial direction, and then discharge the fluid flow from the first diffuser stage in the first axial direction into a second impeller stage, the second impeller stage is configured to rotate about the axis of rotation and has two rows of impeller blades, a first row of impeller blades of the second impeller stage is configured to accept the fluid flow from the diffuser stage, accelerate the fluid flow on a vector away from the axis of rotation, and discharge the fluid flow in the outward radial direction to a second row of impeller blades of the second impeller stage, and the second row of impeller blades of the second impeller stage is configured to accept the fluid flow in the outward radial direction from the first row of impeller blades of the second impeller stage, first accelerate the fluid flow on a vector toward the axis of rotation in the inward radial direction, and then accelerate the fluid flow in the first axial direction, and a second diffuser stage about the axis of rotation and having two rows of diffuser blades, a first row of diffuser blades of the second diffuser stage configured to receive the fluid flow from the second impeller stage, first accelerate the fluid flow in the first axial direction, and then accelerate the fluid flow in on a vector toward the axis of rotation, and a second row of diffuser blades of the second diffuser stage configured to accept the fluid flow in the inward radial direction from the first row of diffuser blades of the second diffuser stage, first accelerate the fluid flow on a vector away from the axis of rotation, then accelerate the fluid flow in the first axial direction, and then discharge the fluid flow from the second diffuser stage in the first axial direction; an annular passageway radially surrounding the multi-stage impeller-diffuser; a manifold configured, in a pump mode of the reversible pump-turbine, to accept fluid flow discharged from the annular passageway in a second axial direction, the second axial direction being opposite to the first axial direction, and direct the fluid flow into the first impeller stage in a first axial direction and, in a turbine mode of the reversible pump-turbine, to accept fluid flow discharged from the first impeller stage in the second axial direction and direct the fluid flow into the annular passageway in the first axial direction; and a motor-generator coupled to the multi-stage impeller-diffuser by a shaft.

Example 17 includes the reversible pump-turbine of Example 16, in which each of the first impeller stage and the first diffuser stage has an outer diameter, in which the outer diameter of the first impeller stage is not larger than the outer diameter of the first diffuser stage.

Example 18 includes the reversible pump-turbine of Example 17, in which the outer diameter of the first impeller stage is substantially equal to the outer diameter of the first diffuser stage.

Example 19 includes a machine comprising: a first impeller stage configured to rotate about an axis of rotation, accept a fluid flow from a first axial direction, redirect the fluid flow through a toroidal fluid flow path, and discharge the fluid flow in a second axial direction opposite to the first axial direction into a first diffuser stage; the first diffuser stage is configured to receive the fluid flow from the first impeller stage, accelerate the fluid flow on a vector toward the axis of rotation, and then discharge the fluid flow from the first diffuser stage in the second axial direction into a second impeller stage; a second impeller stage configured to rotate about the axis of rotation, the second impeller stage having two, separate rows of impeller blades, a first row of impeller blades configured to accept a fluid flow in the second axial direction, accelerate the fluid flow on a vector away from the axis of rotation, and discharge the fluid flow in an outward radial direction to a second row of impeller blades, and the second row of impeller blades configured to accept the fluid flow in the outward radial direction from the first row of impeller blades, first accelerate the fluid flow on a vector toward the axis of rotation in an inward radial direction, and then accelerate the fluid flow in the second axial direction; and a second diffuser stage about the axis of rotation, the second diffuser stage having two rows of second diffuser blades, a first row of second diffuser blades configured to receive the fluid flow from the second impeller stage, first accelerate the fluid flow in the second axial direction, and then accelerate the fluid flow on a vector toward the axis of rotation, and a second row of second diffuser blades configured to accept the fluid flow in the inward radial direction from the first row of second diffuser blades, first accelerate the fluid flow on a vector away from the axis of rotation, then accelerate the fluid flow in the second axial direction, and then discharge the fluid flow from the second diffuser stage in the second axial direction.

Example 20 includes the machine of Example 19, in which the second row of diffuser blades of the second diffuser stage is configured to discharge the fluid flow from the second diffuser stage in the second axial direction into a third impeller stage, in which the third impeller stage is configured to rotate about the axis of rotation, the third impeller stage having two rows of impeller blades, a first row of impeller blades of the third impeller stage configured to accept the fluid flow from the second diffuser stage, accelerate the fluid flow on a vector away from the axis of rotation, and discharge the fluid flow in the outward radial direction to a second row of impeller blades of the third impeller stage, and the second row of impeller blades of the third impeller stage configured to accept the fluid flow in the outward radial direction from the first row of impeller blades of the third impeller stage, first accelerate the fluid flow on a vector toward the axis of rotation in the inward radial direction, and then accelerate the fluid flow in the second axial direction.

Example 21 includes the machine of Example 20, the machine further comprising a third diffuser stage about the axis of rotation, the third diffuser stage having two rows of diffuser blades, a first row of diffuser blades of the third diffuser stage configured to receive the fluid flow from the third impeller stage, first accelerate the fluid flow in the second axial direction, and then accelerate the fluid flow in on a vector toward the axis of rotation, and a second row of diffuser blades of the third diffuser stage configured to accept the fluid flow in the inward radial direction from the first row of diffuser blades of the third diffuser stage, first accelerate the fluid flow on a vector away from the axis of rotation, then accelerate the fluid flow in the second axial direction, and then discharge the fluid flow from the third diffuser stage in the second axial direction.

Example 22 includes the machine of any of Examples 19-21, in which each of the second impeller stage and the second diffuser stage has an outer diameter, in which the outer diameter of the second impeller stage is not larger than the outer diameter of the second diffuser stage.

Example 23 includes the machine of Example 22, in which the outer diameter of the second impeller stage is substantially equal to the outer diameter of the second diffuser stage.

The contents of the present document have been presented for purposes of illustration and description, but such contents are not intended to be exhaustive or limited to the disclosure in the form disclosed. Many modifications and variations will be apparent to those of ordinary skill in the art without departing from the scope and spirit of the disclosure. The aspects of the disclosure in this document were chosen and described to explain the principles of the disclosure and the practical application, and to enable others of ordinary skill in the art to understand the disclosure with various modifications as are suited to the particular use contemplated.

Accordingly, it is to be understood that the disclosure in this specification includes all possible combinations of the particular features referred to in this specification. For example, where a particular feature is disclosed in the context of a particular example configuration, that feature can also be used, to the extent possible, in the context of other example configurations.

Additionally, the described versions of the disclosed subject matter have many advantages that were either described or would be apparent to a person of ordinary skill. Even so, all of these advantages or features are not required in all versions of the disclosed apparatus, systems, or methods.

Also, when reference is made in this application to a method having two or more defined steps or operations, the defined steps or operations can be carried out in any order or simultaneously, unless the context excludes those possibilities.

The terminology used in this specification is for the purpose of describing particular aspects only and is not intended to be limiting of the disclosure. As used herein, the singular forms "a," "an," and "the" are intended to include the plural forms as well, unless the context clearly indicates otherwise. It will be further understood that the terms "comprises" or "comprising," when used in this specification, specify the presence of stated features, integers, steps, operations, elements, or components, but do not preclude the presence or addition of one or more other features, integers, steps, operations, elements, components, or groups thereof. Hence, for example, an article "comprising" or "which comprises" components A, B, and C can contain only components A, B, and C, or it can contain components A, B, and C along with one or more other components.

It is understood that the present subject matter may be embodied in many different forms and should not be construed as being limited to the example configurations set forth in this specification. Rather, these example configurations are provided so that this subject matter will be thorough and complete and will convey the disclosure to those skilled in the art. Indeed, the subject matter is intended to cover alternatives, modifications, and equivalents of these example configurations, which are included within the scope and spirit of the subject matter set forth in this disclosure. Furthermore, in the detailed description of the present subject matter, specific details are set forth to provide a thorough understanding of the present subject matter. It will be clear to those of ordinary skill in the art, however, that the present subject matter may be practiced without such specific details.

I claim:

1. A machine comprising:

a centrifugal impeller stage configured to rotate about an axis of rotation, the impeller stage having three, separate rows of impeller blades, a first row of impeller blades configured to accept a fluid flow in an axial direction, accelerate the fluid flow on a vector away from the axis of rotation, and discharge the fluid flow in an outward radial direction to a second row of impeller blades, the second row of impeller blades configured to accelerate the fluid flow in the outward radial direction, and a third row of impeller blades configured to accept the fluid flow in the outward radial direction from the second row of impeller blades, first accelerate the fluid flow on a vector toward the axis of rotation in an inward radial direction, and then accelerate the fluid flow in the axial direction; and a diffuser stage about the axis of rotation, the diffuser stage having three rows of diffuser blades, a first row of diffuser blades configured to receive the fluid flow from the impeller stage in the axial direction, and then direct the fluid flow on a vector toward the axis of rotation, a second row of diffuser blades configured to direct the fluid flow in the inward radial direction, and a third row of diffuser blades configured to accept the fluid flow in the inward radial direction from the second row of diffuser blades, first direct the fluid flow on a vector away from the axis of rotation, then direct the fluid flow in the axial direction, and then discharge the fluid flow from the diffuser stage in the axial direction.

2. The machine of claim 1, in which each of the impeller stage and the diffuser stage has an outer diameter, in which the outer diameter of the impeller stage is not larger than the outer diameter of the diffuser stage.

3. The machine of claim 2, in which the outer diameter of the impeller stage is substantially equal to the outer diameter of the diffuser stage.

4. The machine of claim 1, in which the impeller stage is a first impeller stage, and in which the second row of diffuser blades is configured to discharge the fluid flow from the diffuser stage in the axial direction into a second impeller stage configured to rotate about the axis of rotation, in which the second impeller stage comprises:

a first row of impeller blades of the second impeller stage configured to accept the fluid flow in the axial direction, accelerate the fluid flow on a vector away from the axis of rotation, and discharge the fluid flow in an outward radial direction to a second row of impeller blades of the second impeller stage;

the second row of impeller blades of the second impeller stage configured to accelerate the fluid flow in the outward radial direction; and a third row of impeller blades of the second impeller stage configured to accept the fluid flow in the outward radial direction from the second row of impeller blades of the second impeller stage, first accelerate the fluid flow on a vector toward the axis of rotation in the inward radial direction, and then accelerate the fluid flow in the axial direction.

5. The machine of claim 4, in which the diffuser stage is a first diffuser stage, the machine further comprising a second diffuser stage about the axis of rotation, the second diffuser stage comprising:

a first row of diffuser blades of the second diffuser stage configured to receive the fluid flow from the second impeller stage in the axial direction, and then direct the fluid flow on a vector toward the axis of rotation; and a second row of diffuser blades of the second diffuser stage configured to direct the fluid flow in the inward radial direction, and a third row of diffuser blades of the second diffuser stage configured to accept the fluid flow in the inward radial direction from the second row of diffuser blades of the second diffuser stage, first direct the fluid flow on a vector away from the axis of rotation, then direct the fluid flow in the axial direction, and then discharge the fluid flow from the diffuser stage in the axial direction.

6. The machine of claim 1, wherein said axial direction is a first axial direction and said second row of impeller blades is configured also to accelerate the fluid flow in a second axial direction, the second axial direction being opposite to the first axial direction.

7. The machine of claim 1, wherein said axial direction is a first axial direction, and said second row of diffuser blades is configured also to direct the fluid flow in a second axial direction, the second axial direction being opposite to the first axial direction.

8. A centrifugal impeller for a machine, the impeller comprising:

a first row of impeller blades configured to accept a fluid flow in an axial direction, accelerate the fluid flow on a vector away from the axis of rotation of the impeller, and discharge the fluid flow in an outward radial direction to a second row of impeller blades;

the second row of impeller blades configured to accelerate the fluid flow in the outward radial direction; and a third row of impeller blades configured to accept the fluid flow in the outward radial direction from the second row of impeller blades, first accelerate the fluid flow on a vector toward the axis of rotation in an inward radial direction, and then accelerate the fluid flow in the axial direction.

9. The impeller of claim 8, wherein said axial direction is a first axial direction, and said second row of impeller blades is configured also to direct the fluid flow in a second axial direction, the second axial direction being opposite to the first axial direction.

10. A diffuser for a machine, the diffuser comprising:

a first row of diffuser blades configured to receive the fluid flow from an impeller stage in an axial direction, and then direct the fluid flow on a vector toward an axis of rotation of the diffuser;

a second row of diffuser blades configured to direct the fluid flow in an inward radial direction; and a third row of diffuser blades configured to accept the fluid flow in the inward radial direction from the second row of diffuser blades, first direct the fluid flow on a vector away from the axis of rotation, then direct the fluid flow in the first axial direction, and then discharge the fluid flow from the diffuser stage in the first axial direction.

11. The diffuser of claim 10, wherein said axial direction is a first axial direction, and said second row of diffuser blades is configured also to direct the fluid flow in a second axial direction, the second axial direction being opposite to the first axial direction.

* * * * *